US011670227B2

(12) United States Patent
Xu et al.

(10) Patent No.: US 11,670,227 B2
(45) Date of Patent: Jun. 6, 2023

(54) PIXEL CIRCUIT, DRIVING METHOD FOR PIXEL CIRCUIT, AND DISPLAY PANEL

(71) Applicant: SOUTH CHINA UNIVERSITY OF TECHNOLOGY, Guangdong (CN)

(72) Inventors: Miao Xu, Guangdong (CN); Lei Zhou, Guangdong (CN); Min Li, Guangdong (CN); Hongmeng Li, Guangdong (CN); Hua Xu, Guangdong (CN); Zikai Chen, Guangdong (CN); Jianhua Zou, Guangdong (CN); Lei Wang, Guangdong (CN); Junbiao Peng, Guangdong (CN); Hong Tao, Guangdong (CN)

(73) Assignee: SOUTH CHINA UNIVERSITY OF TECHNOLOGY, Guangdong (CN)

( * ) Notice: Subject to any disclaimer, the term of this patent is extended or adjusted under 35 U.S.C. 154(b) by 0 days.

(21) Appl. No.: 17/798,539

(22) PCT Filed: Jul. 22, 2020

(86) PCT No.: PCT/CN2020/103431
§ 371 (c)(1),
(2) Date: Aug. 9, 2022

(87) PCT Pub. No.: WO2021/159664
PCT Pub. Date: Aug. 19, 2021

(65) Prior Publication Data

US 2023/0087472 A1 Mar. 23, 2023

(30) Foreign Application Priority Data

Feb. 14, 2020 (CN) ..... 202010092739.5

(51) Int. Cl.
*G09G 3/32* (2016.01)

(52) U.S. Cl.
CPC ..... *G09G 3/32* (2013.01); *G09G 2300/0426* (2013.01); *G09G 2300/0819* (2013.01);
(Continued)

(58) Field of Classification Search
CPC ..... G09G 3/32; G09G 2300/0426; G09G 2300/0819; G09G 2300/0842;
(Continued)

(56) References Cited

U.S. PATENT DOCUMENTS 11,114,030 B1 * 9/2021 Lu ..... G09G 3/3233
2016/0300900 A1 10/2016 Miyake
(Continued)

FOREIGN PATENT DOCUMENTS

CN 102074192 A 5/2011
CN 102074193 A 5/2011
(Continued)

OTHER PUBLICATIONS

International Search Report from corresponding PCT Application No. PCT/CN2020/103431, dated Nov. 17, 2020.

*Primary Examiner* — Andrew Sasinowski
(74) *Attorney, Agent, or Firm* — Burns & Levinson, LLP; Joseph M. Maraia

(57) ABSTRACT

Disclosed are to a pixel circuit, a method for driving the pixel circuit and a display panel. The pixel circuit includes a data write module, a storage module, a drive module and a light emitting device. The drive module includes a first control terminal and a second control terminal. The data write module is configured to write, at a data write stage, a data signal into the first control terminal of the drive module, the storage module is configured to maintain a potential of the first control terminal, the second control terminal is electrically connected to a pulse-width modulation (PWM) signal input terminal of the pixel circuit, and is configured to control the drive module to provide discontinuous drive current according to a PWM signal from the PWM signal
(Continued)

input terminal at a light emission stage, and the light emitting device emits light in response to the discontinuous drive current.

16 Claims, 23 Drawing Sheets

(52) U.S. Cl.
CPC ..... *G09G 2300/0842* (2013.01); *G09G 2310/0267* (2013.01); *G09G 2310/0275* (2013.01); *G09G 2310/061* (2013.01); *G09G 2310/08* (2013.01); *G09G 2320/0242* (2013.01); *G09G 2330/028* (2013.01)

(58) Field of Classification Search
CPC ... G09G 2310/0267; G09G 2310/0275; G09G 2310/061; G09G 2310/08; G09G 2320/0242; G09G 2330/028
See application file for complete search history.

(56) References Cited

U.S. PATENT DOCUMENTS

2018/0075798 A1* 3/2018 Nho ..... G09G 3/32
2018/0301080 A1* 10/2018 Shigeta ..... G09G 3/32
2019/0325816 A1* 10/2019 Lin ..... G09G 3/3208
2020/0043405 A1* 2/2020 Akimoto ..... G09G 3/3233
2020/0098307 A1 3/2020 Li et al.
2021/0358419 A1* 11/2021 Shen ..... G09G 3/3275

FOREIGN PATENT DOCUMENTS

CN 102074194 A 5/2011
CN 102122487 A 7/2011
CN 202058415 U 11/2011
CN 202058416 U 11/2011
CN 202058417 U 11/2011
CN 202058418 U 11/2011
CN 203217924 U 9/2013
CN 104882096 A 9/2015
CN 105741781 A 7/2016
CN 107424563 A 12/2017
CN 107481664 A 12/2017
CN 110036435 A 7/2019
CN 111210765 A 5/2020
JP 2009069571 A 4/2009

* cited by examiner

PIXEL CIRCUIT, DRIVING METHOD FOR PIXEL CIRCUIT, AND DISPLAY PANEL

CROSS-REFERENCE TO RELATED APPLICATIONS

This is a National Stage Application filed under 35 U.S.C. 371 based on International Patent Application No. PCT/CN2020/103431, filed on Jul. 22, 2020, which claims priority to Chinese Patent Application No. 202010092739.5 filed on Feb. 14, 2020, disclosures of both of which are incorporated herein by reference in their entireties.

TECHNICAL FIELD

The present application relates to the field of display technology and, for example, to a pixel circuit, a method for driving the pixel circuit, and a display panel.

BACKGROUND

A Micro Light Emitting Diode (Micro-LED) display apparatus has been paid more and more attention because of miniaturization of Light Emitting Diode (LED) and higher luminance, luminous efficiency and lower power consumption than an Organic Light Emitting Diode (OLED) display device.

The Micro-LED has low luminous efficiency in a case of working at low current density. The luminous wavelength is different from that of high grayscale level, which causes the color shift of the display color of the Micro-LED display device apparatus. When the Micro-LED display apparatus displays, the Micro-LED display apparatus can be driven to emit light by using a pulse-width modulation (PWM) signal and digital driving mode through a power supply, thus improving the color shift problem. Thus, the data signal and the PWM signal of the power supply need to be synchronized accurately, which made the design of the driving circuit for Micro-LED very complicated.

SUMMARY

The present application provides a pixel circuit, a method for driving a pixel circuit and a display panel to reduce the design complexity of the driver circuit to improve the color shift problem.

In the first aspect, embodiments of the present application provide a pixel circuit including a data write module, a storage module, a drive module, and a light emitting device.

The drive module includes a first control terminal and a second control terminal. The data write module is configured to write, at a data write stage, a data signal into the first control terminal of the drive module, the storage module is configured to maintain a potential of the first control terminal, the second control terminal is electrically connected to a PWM signal input terminal of the pixel circuit, and at a light emission stage, the second control terminal is configured to control the drive module to provide discontinuous current according to a PWM signal input from the PWM signal input terminal, and the light emitting device emits light in response to the discontinuous drive current.

In the second aspect, embodiments of the present disclosure further include a method for driving a pixel circuit. The pixel circuit includes a data write module, a storage module, a drive module and a light emitting device, where the drive module includes a first control terminal and a second control terminal. The method includes steps described below.

At a data write stage, the data write module of the pixel circuit writes a data signal into a first control terminal of the drive module of the pixel circuit, and the storage module maintains a voltage of the first control terminal of the drive module.

At a light emission stage, the second control terminal of the drive module controls the drive module to provide discontinuous drive current according to a PWM signal input from a PWM signal input terminal, and the light emitting device emits light in response to the discontinuous drive current.

In a third aspect, embodiments of the present application further provide a display panel including the pixel circuit of any embodiments of the present application.

DETAILED DESCRIPTION

Figure 1:
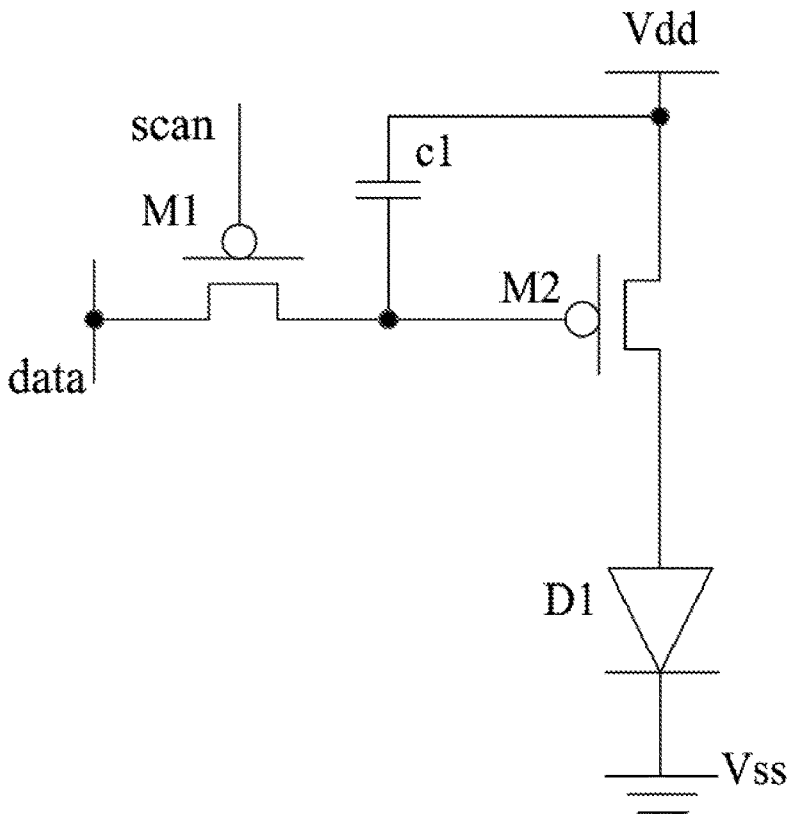
FIG. 1 is a structure diagram of a pixel circuit in the related art.
Figure 2:
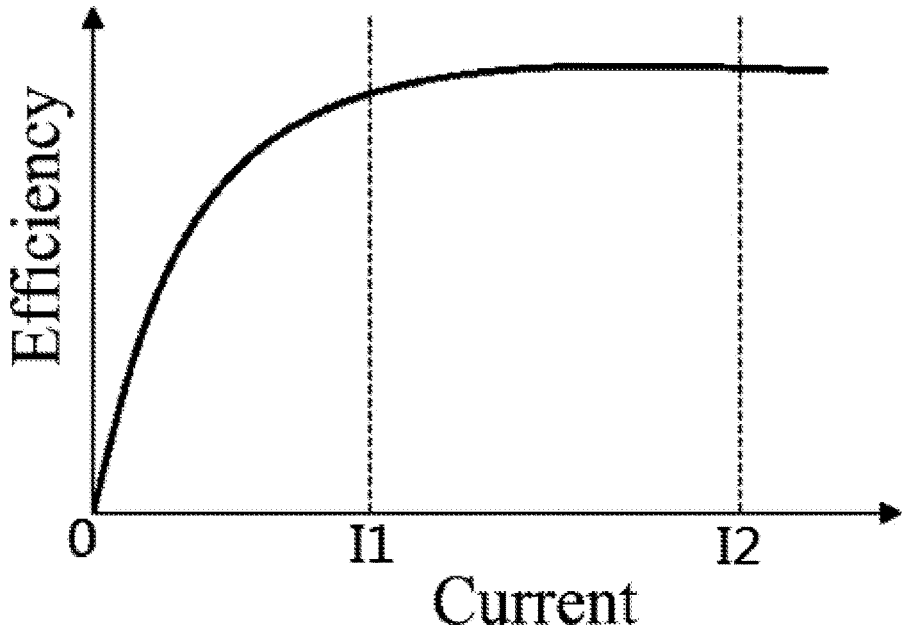
FIG. 2 is a curve diagram of a relationship between current of a light emitting diode and luminous efficiency of a light emitting diode in the related art.

FIG. 1 is a structure diagram of a pixel circuit in the related art. As shown in FIG. 1, the pixel circuit includes a switch transistor M1, a drive transistor M2, a storage capacitor c1 and a light emitting diode D1. The gate of the switch transistor M1 is electrically connected to the scan line, the first electrode of the switch transistor M1 is electrically connected to the data line, a second electrode of the switch transistor M1 is electrically connected to the gate of the drive transistor M2 and the first electrode of the storage capacitor c1, the first electrode of the drive transistor M2 and the second electrode of the storage capacitor c1 are electrically connected to the first power supply signal line Vdd, the second electrode of the drive transistor M2 is electrically connected to the anode of the light emitting diode D1, and the cathode of the light emitting diode D1 is electrically connected to the second power supply signal line Vss. FIG. 2 is a curve diagram of a relationship between current of a light emitting diode and luminous efficiency of a light emitting diode in the related art. The abscissa is a current I flowing through the light emitting diode, and the ordinate is the luminous efficiency of the light emitting diode. As shown in FIG. 2, when the light emitting diode works at a low current, the luminous efficiency of the light emitting diode is relatively low, and the light emitting wavelength is different from that of high grayscale level, which easily causes problems such as low luminous efficiency and color shift of the light emitting diode. Therefore, the power supply input uses the PWM signal, and the light emitting diode D1 can be driven to emit light in cooperation with a digital drive mode. In the process of driving the light emitting diode D1 to emit light by using the digital drive mode, the light emitting diode D1 works at the high gray-scale level and high brightness. The problems of low luminous efficiency and color shift of the light emitting diode are avoided. In addition, the light emitting time of the light emitting diode may be controlled by the PWM signal of the power supply. Due to the persistence of vision of human eyes, the brightness integral perceived by human eyes in one frame time (including 12 subframes) is the actual grayscale brightness of the pixel. Therefore, one frame can be divided into a plurality of subframes according to its grayscale level, and the luminous brightness of the low grayscale level is relatively low, the corresponding subframe time is relatively short, and the luminous brightness of the high grayscale level is relatively high, and the corresponding subframe time is relatively long. When each subframe is controlled to emit light, the data signal and the PWM signal of the power supply need to be synchronized accurately, so that the design of the driver circuit for driving the pixel circuit is very complicated and the manufacturing cost of the display panel is increased.

Figure 3:
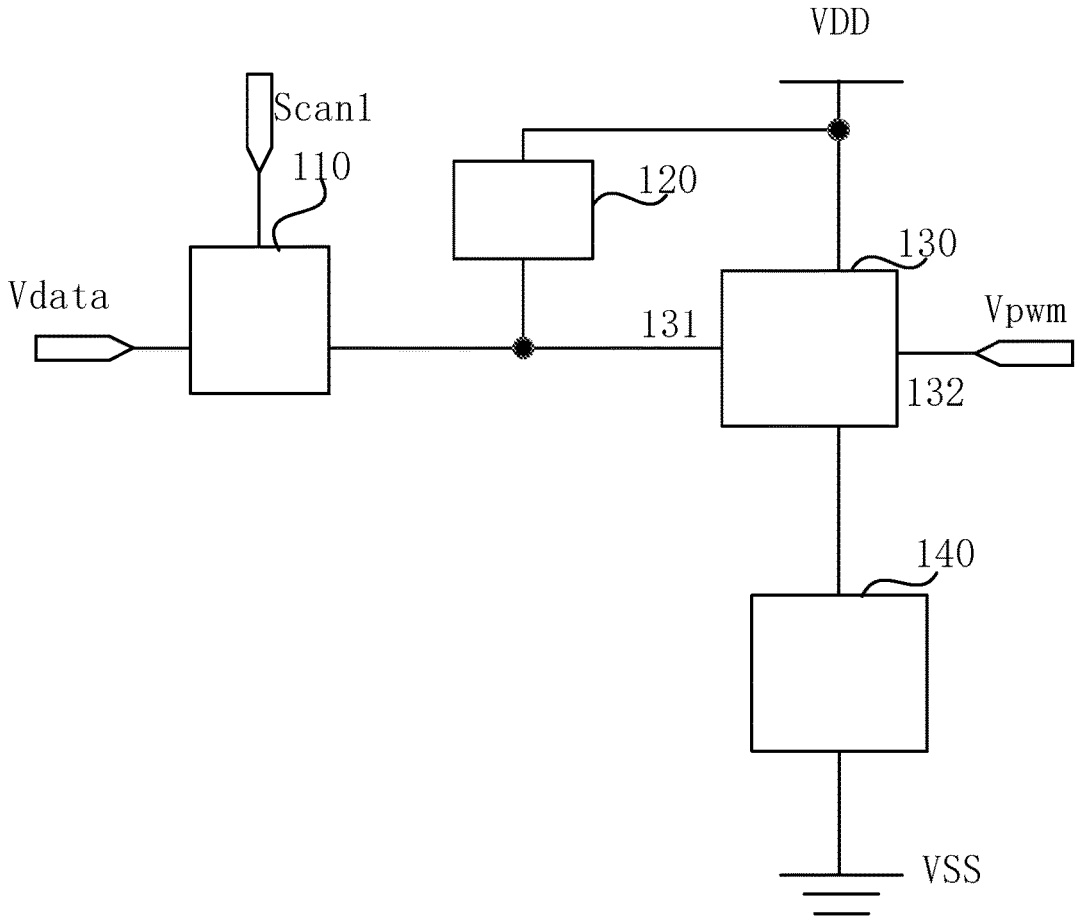
FIG. 3 is a structure diagram of a pixel circuit according to an embodiment of the present application.

An embodiment of the present application provides a pixel circuit. FIG. 3 is a structure diagram of a pixel circuit according to an embodiment of the present application. As shown in FIG. 3, the pixel circuit includes a data write module 110, a storage module 120, a drive module 130 and the light emitting device 140. The drive module 130 includes a first control terminal 131 and a second control terminal 132. The data write module 110 is configured to write, at a data write stage, a data signal into the first control terminal of the drive module 130, the storage module 120 is configured to maintain a potential of the first control terminal 131, the second control terminal 132 is electrically connected to a PWM signal input terminal Vpwm of the pixel circuit, and is configured to control the drive module 130 to provide discontinuous drive current according to a PWM signal input from Vpwm at a light emission stage, and the light emitting device 140 emits light in response to the discontinuous drive current.

Figure 4:
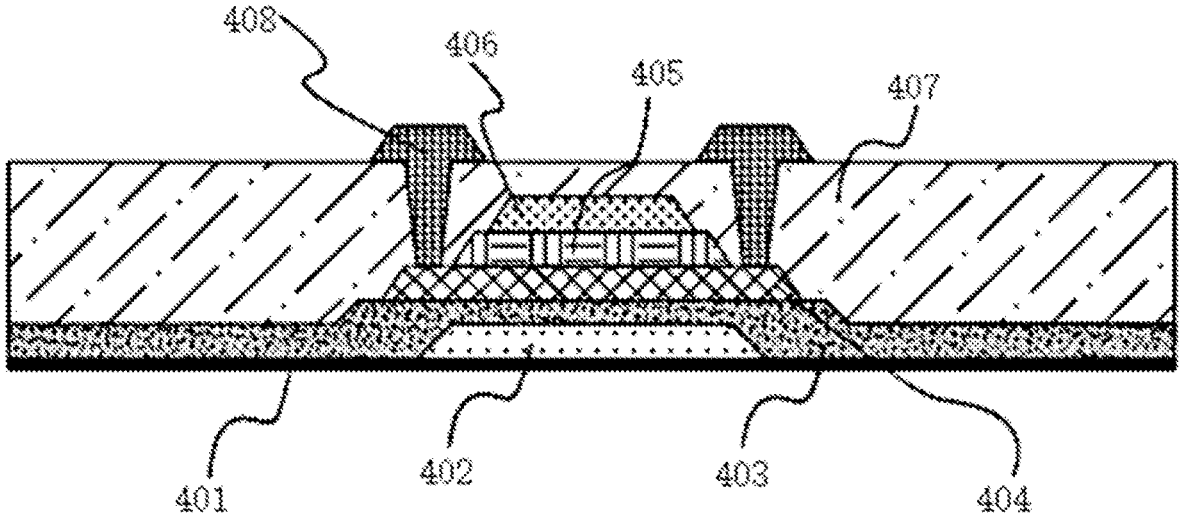
FIG. 4 is a structure diagram of a dual-gate N-type transistor.

Exemplarily, the first control terminal 131 of the drive module 130 receives a data signal at the data write stage, and maintains the data voltage of the first control terminal 131 through the storage module 120. The second control terminal 132 inputs the PWM signal of Vpwm. The PWM signal has a first level and a second level. The first level of the PWM signal and the second level of the PWM signal directly affect the transfer characteristic curve of the drive module 130, so that the drive module 130 is in turned on or turned off respectively when the PWM signal outputs different levels. Exemplarily, the drive module 130 may include a dual-gate N-type transistor. FIG. 4 is a structure diagram of a dual-gate N-type transistor. As shown in FIG. 4, the dual-gate N-type transistor includes a substrate 401, a bottom gate 402, a first gate insulation layer 403, an active layer 404, a second gate insulation layer 405, a top gate 406, a passivation layer 407 and a source-drain electrode layer 408 in turn. The substrate 401 may be glass. The bottom gate 402, the top gate 406, and the source-drain electrode layer 408 are all patterned from a conductive layer. The conductive layer may be molybdenum (Mo), aluminum (Al), silver (Ag), titanium (Ti), copper (Cu), indium tin oxide (ITO), indium zinc oxide (IZO), Ag nanowires, carbon nanotubes, graphene conductive films or the like. The conductive layer may be a single layer or a laminated layer. The active layer 404 may be a lanthanide-doped metal oxide semiconductor layer. The first gate insulation layer 403, the second gate insulation layer 405 and the passivation layer 407 may be inorganic insulation layers such as silicon oxide (SiOx), silicon nitride (SiNx) or aluminum oxide (AlOx), or other organic insulation layers, each of which may be a single layer or a laminated structure. In a process of manufacturing the dual-gate N-type transistor, the threshold voltage of the dual-gate N-type transistor may be adjusted by adjusting the material and thickness of the first gate insulation layer 403 and the material and thickness of the second gate insulation layer 405. When a constant bias voltage is applied to the gate of the dual-gate N-type transistor, the relationship is as shown in formula (1):

$$\frac{dV_{th}}{dV_{gate2}} = -\frac{C_{ACT}C_{GI2}}{C_{GI1}(C_{ACT}+C_{GI2})} \quad (1)$$

$V_{gate2}$ is a voltage applied to the top gate, $C_{ACT}$ is a capacitor when the active layer is drained, $C_{GI2}$ is a capacitor of the second gate insulation layer, and $C_{GI1}$ is a capacitor of the first gate insulation layer. Thus, the charge coupling effect between the bottom gate 402 and the top gate 406 is indicated when a channel of the dual-gate N-type transistor is completely drained.

Figure 5:
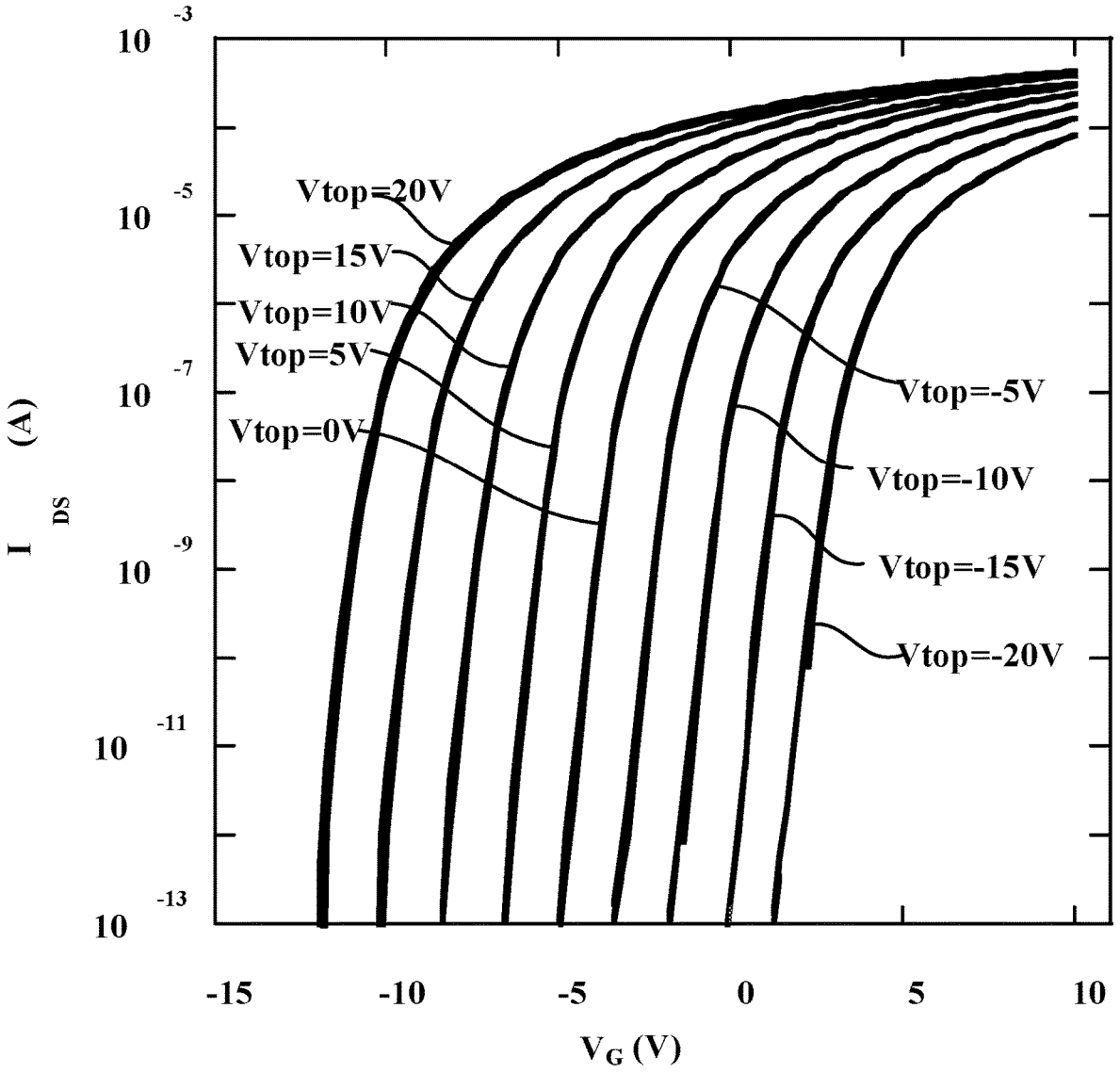
FIG. 5 is a schematic diagram of a current of a dual-gate N-type transistor when different constant bias voltages are applied to a top gate of the dual-gate N-type transistor.
Figure 6:
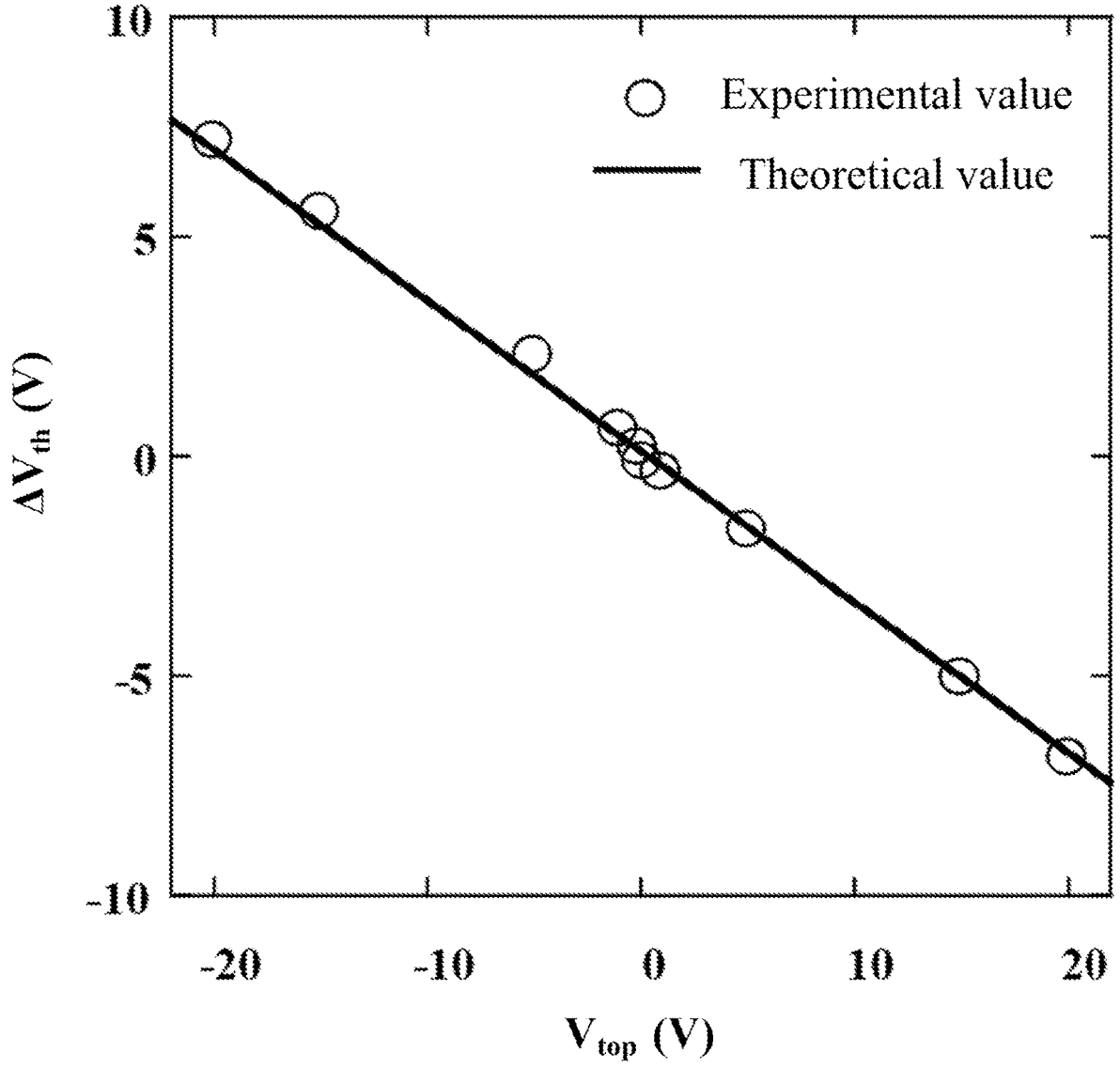
FIG. 6 is a schematic diagram of a transfer curve of applying different constant bias voltages to a top gate of a dual-gate N-type transistor.
Figure 7:
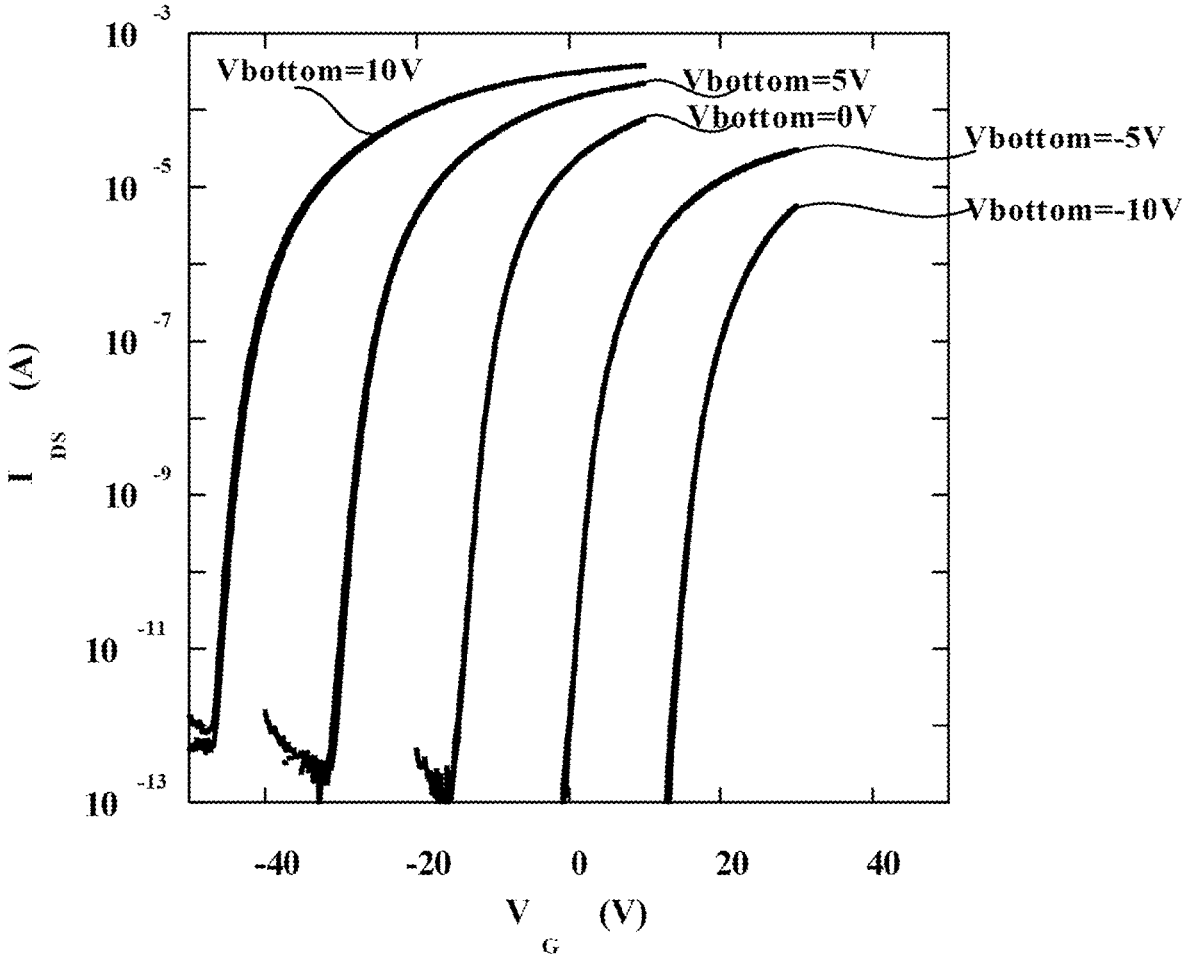
FIG. 7 is a schematic diagram of a current of a dual-gate N-type transistor when different constant bias voltages are applied to a bottom gate of the dual-gate N-type transistor.
Figure 8:
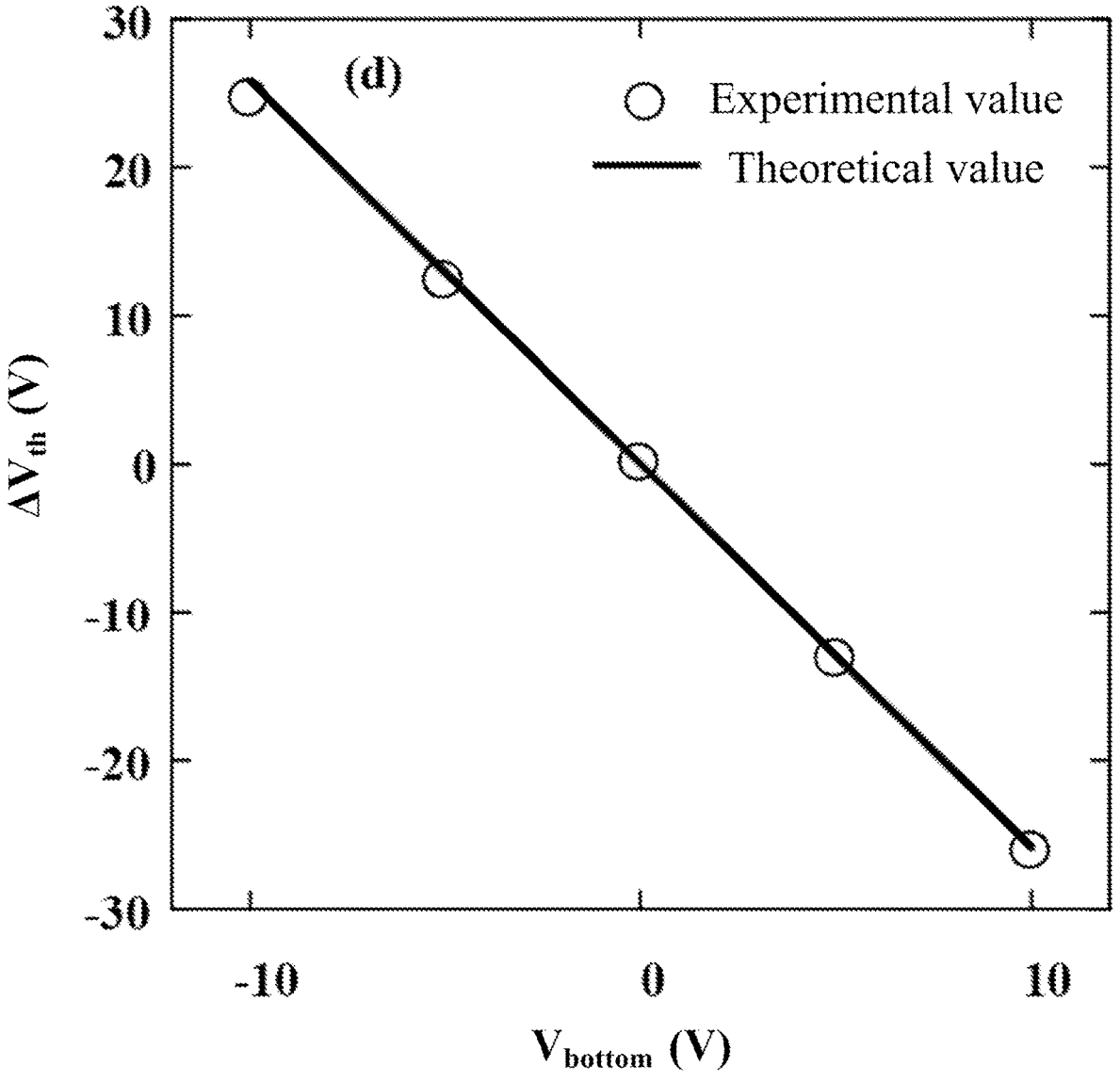
FIG. 8 is a schematic diagram of a transfer curve of applying different constant bias voltages to a bottom gate of a dual-gate N-type transistor.

Table 1 shows the material and thickness of various film layers of the dual-gate N-type transistor. On this basis, different constant bias voltages are applied to the top gate of the dual-gate N-type transistor, and the change of the transfer curve of the dual-gate N-type transistor is tested. FIG. 5 is a schematic diagram of a current of a double-gate N-type transistor when different constant bias voltages are applied to a top gate of the dual-gate N-type transistor, where the abscissa is the voltage $V_G$ applied to the top gate, and the ordinate is the current $I_{DS}$ of the dual-gate N-type transistor. FIG. 6 is a schematic diagram of a transfer curve of applying different constant bias voltages to a top gate of a dual-gate N-type transistor, where the abscissa is a constant bias voltage $V_{top}$ of the top gate of the dual-gate N-type transistor, and the ordinate is the change value of the threshold voltage of dual-gate N-type transistor. A theoretical value is the change value of the threshold voltage calculated by formula (1), and the experimental value is the change value of the threshold voltage obtained by testing in the experiment. As shown in FIGS. 5 and 6, the constant voltage of the top gate ranges from −20 V to 20 V, and a step is 5 V for one test recording point. When a negative constant voltage is applied to the top gate, the threshold voltage of the dual-gate N-type transistor will shift to a positive direction in parallel, and when a positive constant voltage is applied to the top gate, the threshold voltage shifts to a negative direction in parallel. From the comparison between the theoretical value and the experimental value in FIG. 6, it can be seen that the change value of the threshold voltage obtained from the experimental test is very close to the theoretical value. Formula (1) is applicable to the relationship between the threshold voltage of the dual-gate N-type transistor and the bias voltage of the top gate. FIG. 7 is a schematic diagram of a current of a dual-gate N-type transistor when different constant bias voltages are applied to a bottom gate of the dual-gate N-type transistor, where the abscissa is the voltage $V_G$ applied to the bottom gate, and the ordinate is the current $I_{DS}$ of the dual-gate N-type transistor. FIG. 8 is a schematic diagram of a transfer curve of applying different constant bias voltages to a bottom gate of a dual-gate N-type transistor, where the abscissa is a constant bias voltage $V_{bottom}$ of the bottom gate of the dual-gate N-type transistor, and the ordinate is the change value of the threshold voltage of dual-gate N-type transistor. A theoretical value is the change value of the threshold voltage calculated by formula (1), and the experimental value is the change value of the threshold voltage obtained by testing in the experiment. As shown in FIGS. 7 and 8, the variation of threshold voltage is the same as that of different constant bias applied to the top gate. It can be seen that an effective spatial interactive electric field is formed between the top gate of the dual-gate N-type transistor and the bottom gate of the dual-gate N-type transistor. When a constant voltage is applied to the top gate, the accumulation effect of electrons in a front channel will change, that is, when a constant negative voltage is applied, the vertically distributed space electric field will be enhanced, so that more electrons will be trapped by the insulation layer/active layer interface, and then the threshold voltage of the dual-gate N-type transistor will be more positive. When a positive constant voltage is applied, the vertically distributed space electric field will be weaken, thus resulting in a more negative threshold voltage of the dual-gate N-type transistor.

TABLE 1

| | Bottom gate | First gate insulation layer | Active layer | Second gate insulation layer | Top gate | First passivation layer | Source electrode and drain electrode | Second passivation layer |
|---|---|---|---|---|---|---|---|---|
| Material | Mo | AlOx | Nd—IZO | $SiO_2$ | Mo/Al/Mo | SiOx | Mo/Al/Mo | SiNx |
| Thickness | 200 nm | 200 nm | 30 nm | 300 nm | 20/300/50 nm | 200 nm | 20/300/50 nm | 300 nm |

Figure 9:
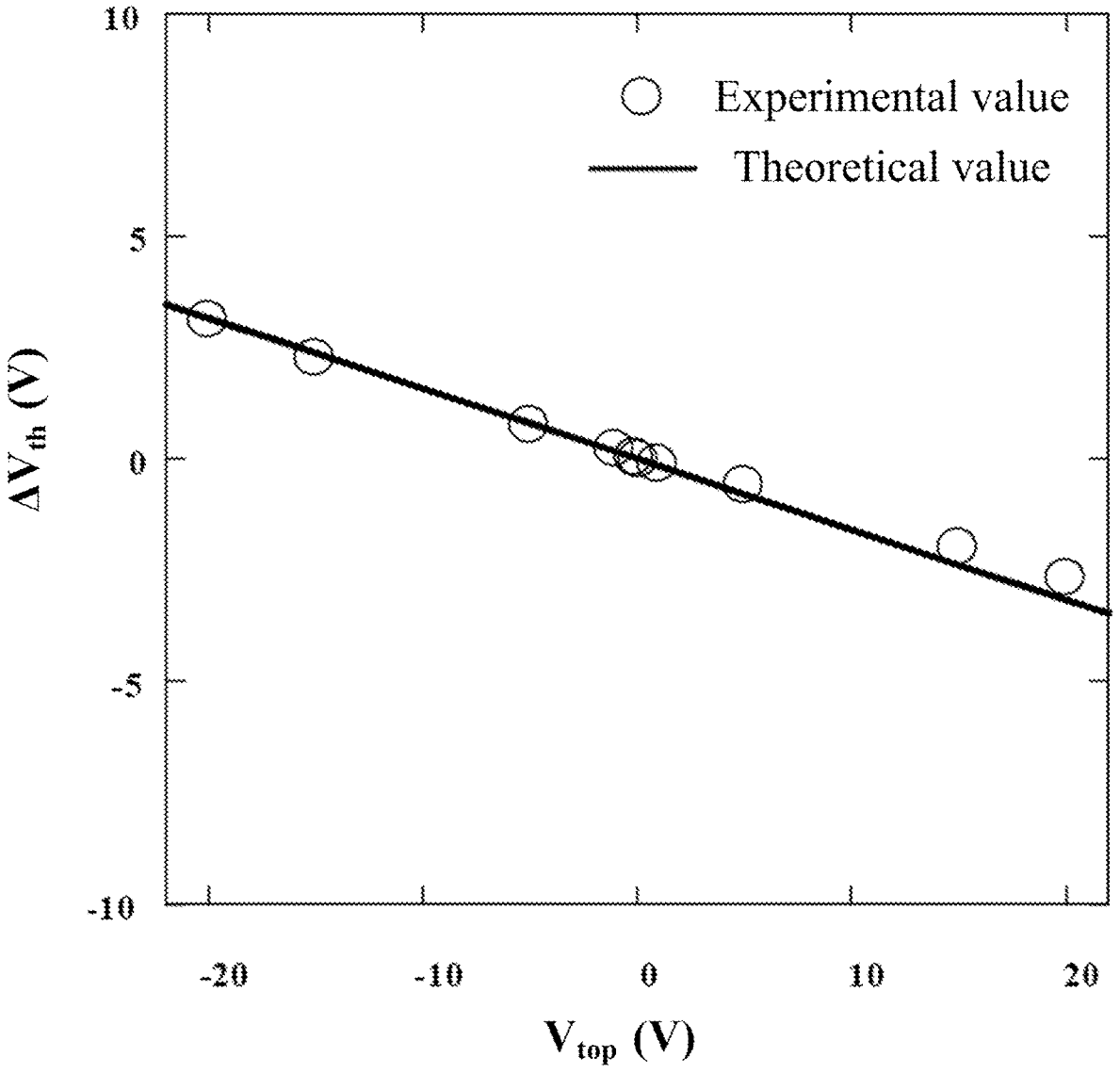
FIG. 9 is a schematic diagram of a transfer curve of applying different constant bias voltages to a top gate of a dual-gate N-type transistor when a thickness of a second gate insulation layer is 500 nm.
Figure 10:
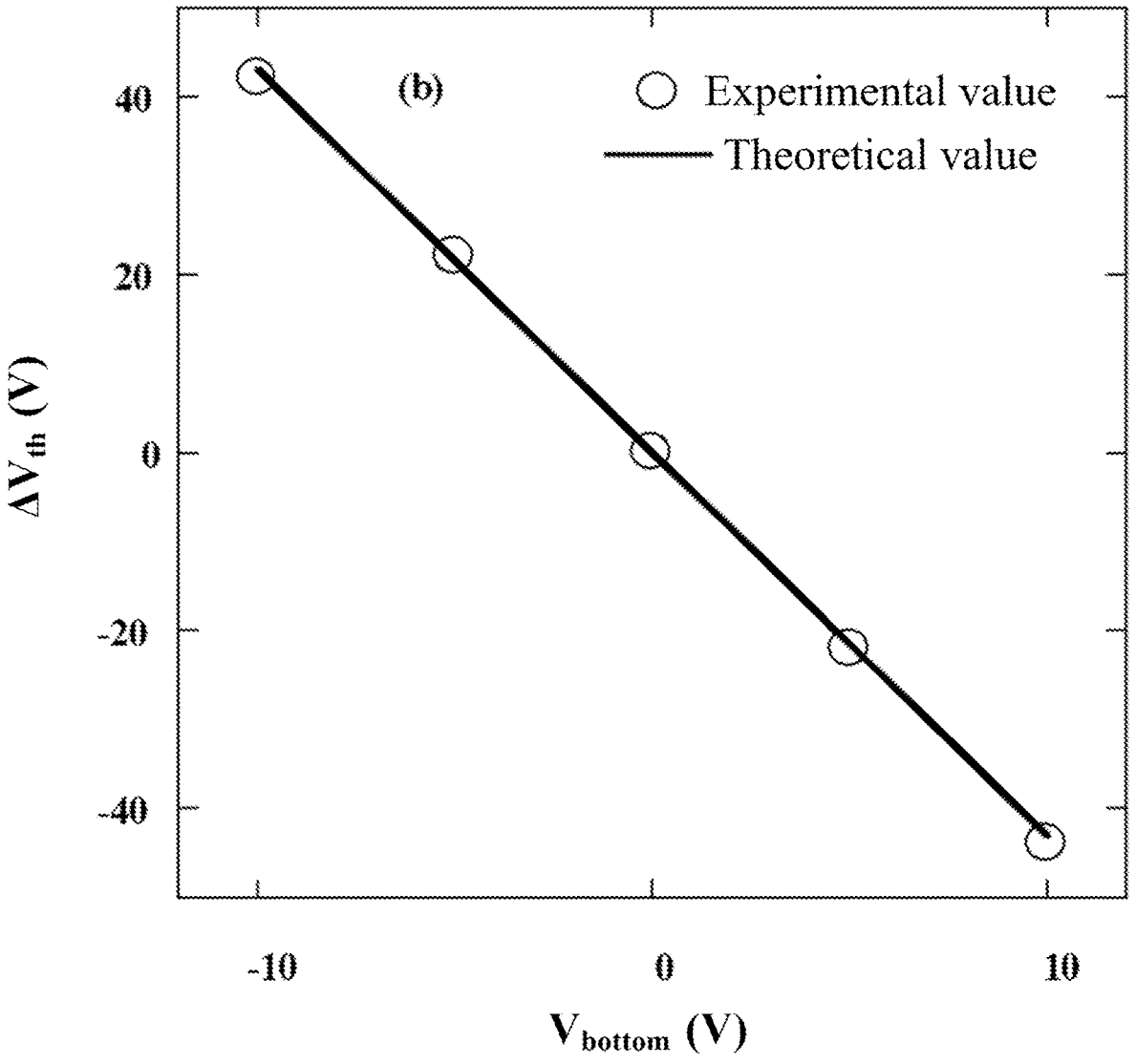
FIG. 10 is a schematic diagram of a transfer curve of applying different constant bias voltages to a bottom gate of a dual-gate N-type transistor when a thickness of a second gate insulation layer is 500 nm.

Table 2 shows the material and thickness of various film layers of another dual-gate N-type transistor. The difference from Table 1 is that the thickness of the second gate insulation layer is 500 nm. FIG. 9 is a schematic diagram of a transfer curve of applying different constant bias voltages to a top gate of a dual-gate N-type transistor when a thickness of a second gate insulation layer is 500 nm, where the abscissa is a constant bias voltage $V_{top}$ of the top gate of the dual-gate N-type transistor, and the ordinate is the change value of the threshold voltage of dual-gate N-type transistor. A theoretical value is the change value of the threshold voltage calculated by formula (1), and the experimental value is the change value of the threshold voltage obtained by testing in the experiment. As can be seen from FIG. 9, a regulated amplitude of the threshold voltage of a dual-gate N-type transistor including the second gate insulation layer with the thickness of 500 nm is smaller than that of the dual-gate N-type transistor of the second gate insulation layer with the thickness of 300 nm. It is indicated that for a thicker second gate insulation layer, the vertical electric field generated from the top gate to the bottom gate will be obviously weakened. FIG. 10 is a schematic diagram of a transfer curve of applying different constant bias voltages to a bottom gate of a dual-gate N-type transistor when a thickness of a second gate insulation layer is 500 nm, where the abscissa is a constant bias voltage $V_{bottom}$ of the bottom gate of the dual-gate N-type transistor, and the ordinate is the change value of the threshold voltage of dual-gate N-type transistor. A theoretical value is the change value of the threshold voltage calculated by formula (1), and the experimental value is the change value of the threshold voltage obtained by testing in the experiment. The variation of threshold voltage is the same as that of different constant bias applied to the top gate.

TABLE 2

| | Bottom gate | First gate insulation layer | Active layer | Second gate insulation layer | Top gate | First passivation layer | Source and drain electrode | Second passivation layer |
|---|---|---|---|---|---|---|---|---|
| Material | Mo | AlOx | Nd—IZO | $SiO_2$ | Mo/Al/Mo | SiOx | Mo/Al/Mo | SiNx |
| Thickness | 200 nm | 200 nm | 30 nm | 500 nm | 20/300/50 nm | 200 nm | 20/300/50 nm | 300 nm |

Figure 11:
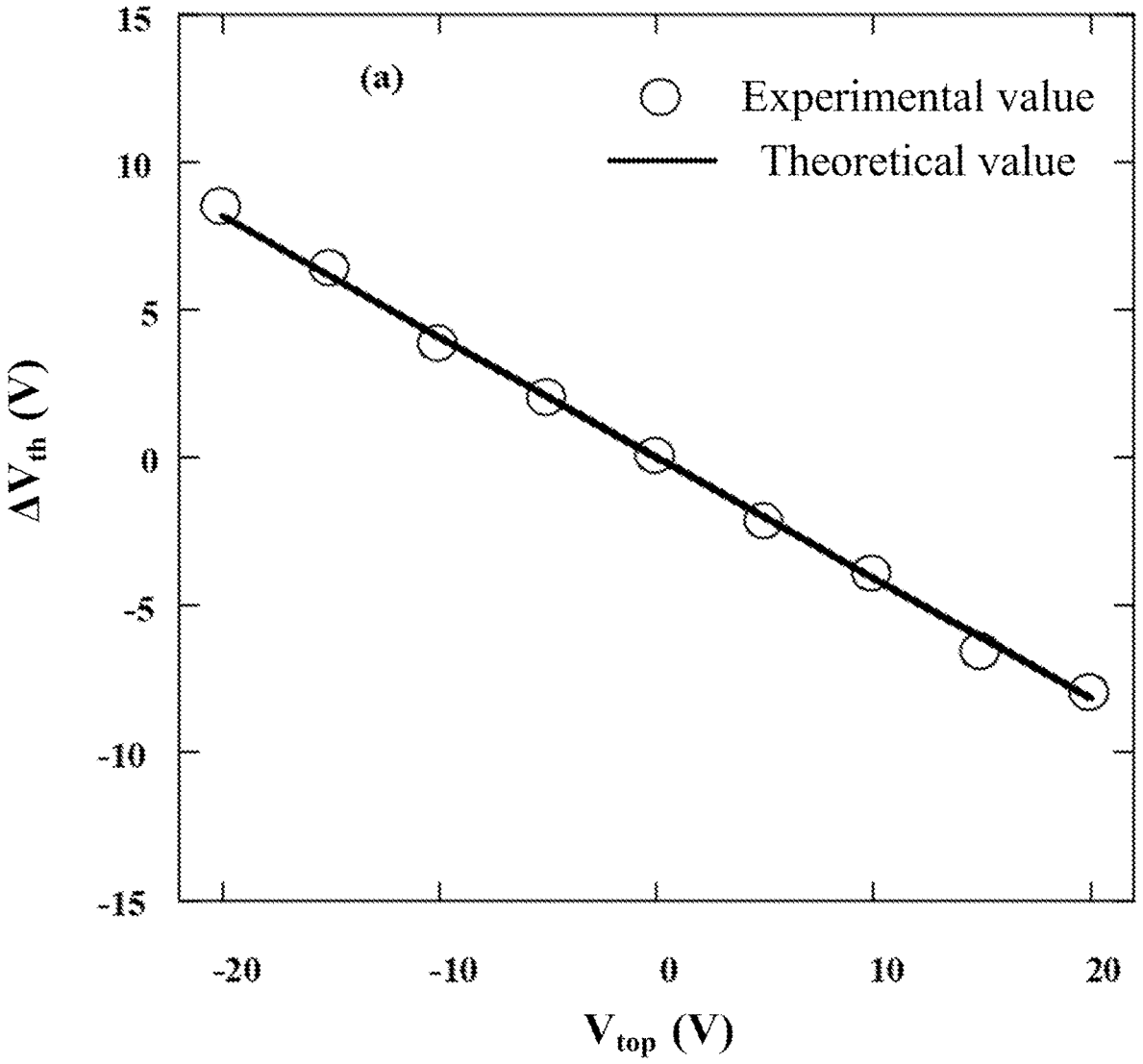
FIG. 11 is a schematic diagram of a transfer curve of applying different constant bias voltages to a top gate of a dual-gate N-type transistor when a thickness of a second gate insulation layer is 150 nm.
Figure 12:
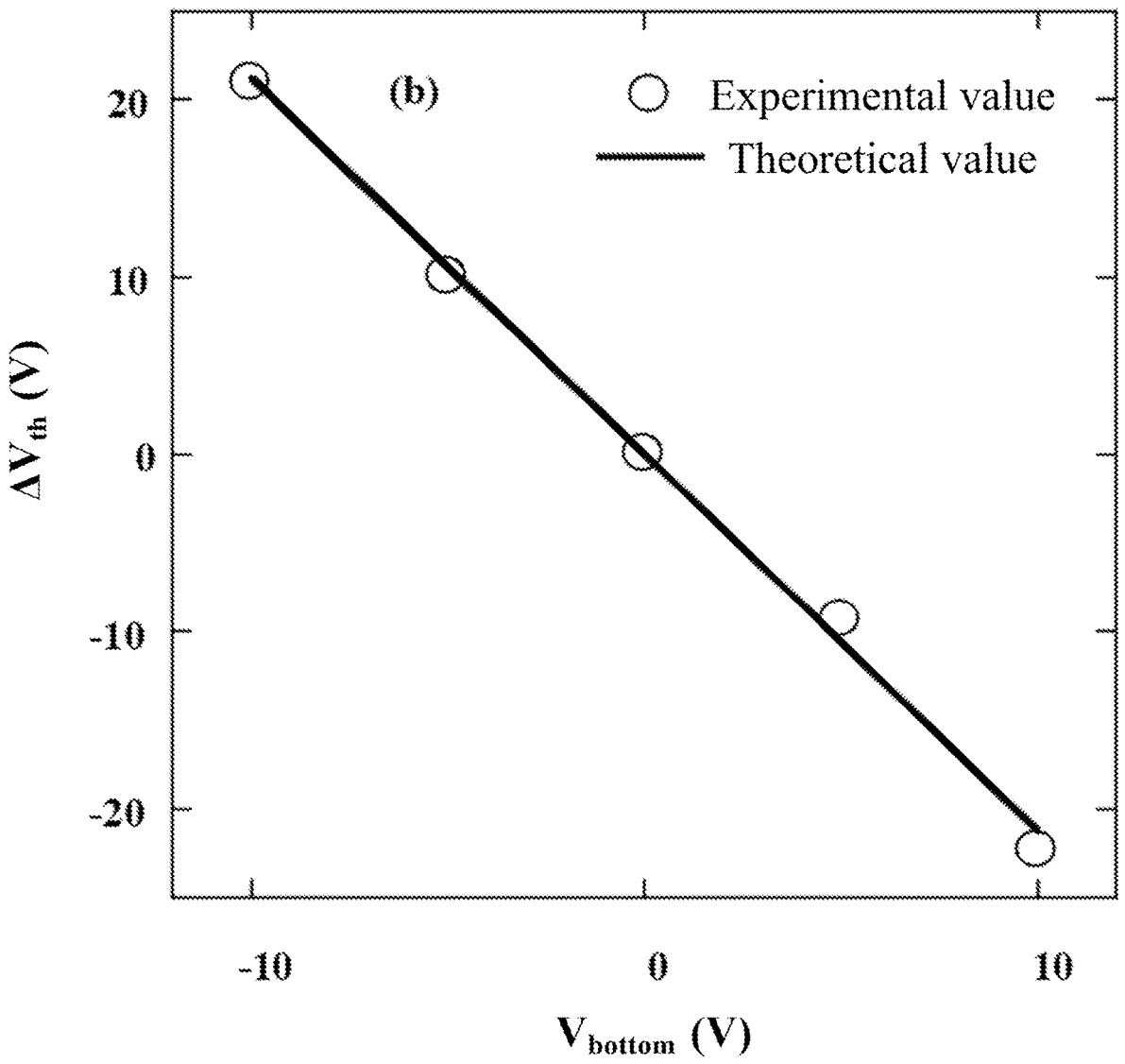
FIG. 12 is a schematic diagram of a transfer curve of applying different constant bias voltages to a bottom gate of a dual-gate N-type transistor when a thickness of a second gate insulation layer is 150 nm.

Table 3 shows the material and thickness of various film layers of another dual-gate N-type transistor. The difference from Table 1 is that the thickness of the first gate insulation layer is 150 nm. FIG. 11 is a schematic diagram of a transfer curve of applying different constant bias voltages to a top gate of a dual-gate N-type transistor when a thickness of a second gate insulation layer is 150 nm, where the abscissa is a constant bias voltage $V_{top}$ of the top gate of the dual-gate N-type transistor, and the ordinate is the change value of the threshold voltage of dual-gate N-type transistor. A theoretical value is the change value of the threshold voltage calculated by formula (1), and the experimental value is the change value of the threshold voltage obtained by testing in the experiment. As can be seen from FIG. 11, a regulated amplitude of the threshold voltage of a dual-gate N-type transistor including the first gate insulation layer with the thickness of 150 nm is larger than that of the dual-gate N-type transistor of the first gate insulation layer with the thickness of 200 nm, it is indicated that for a thinner first gate insulation layer, the vertical electric field generated from the top gate to the bottom gate will be obviously enhanced. FIG. 12 is a schematic diagram of a transfer curve of applying different constant bias voltages to a bottom gate of a dual-gate N-type transistor when a thickness of a second gate insulation layer is 150 nm, where the abscissa is a constant bias voltage $V_{bottom}$ of the bottom gate of the dual-gate N-type transistor, and the ordinate is the change value of the threshold voltage of dual-gate N-type transistor. A theoretical value is the change value of the threshold voltage calculated by formula (1), and the experimental value is the change value of the threshold voltage obtained by testing in the experiment. The variation of threshold voltage is the same as that of different constant bias applied to the top gate.

Figure 13:
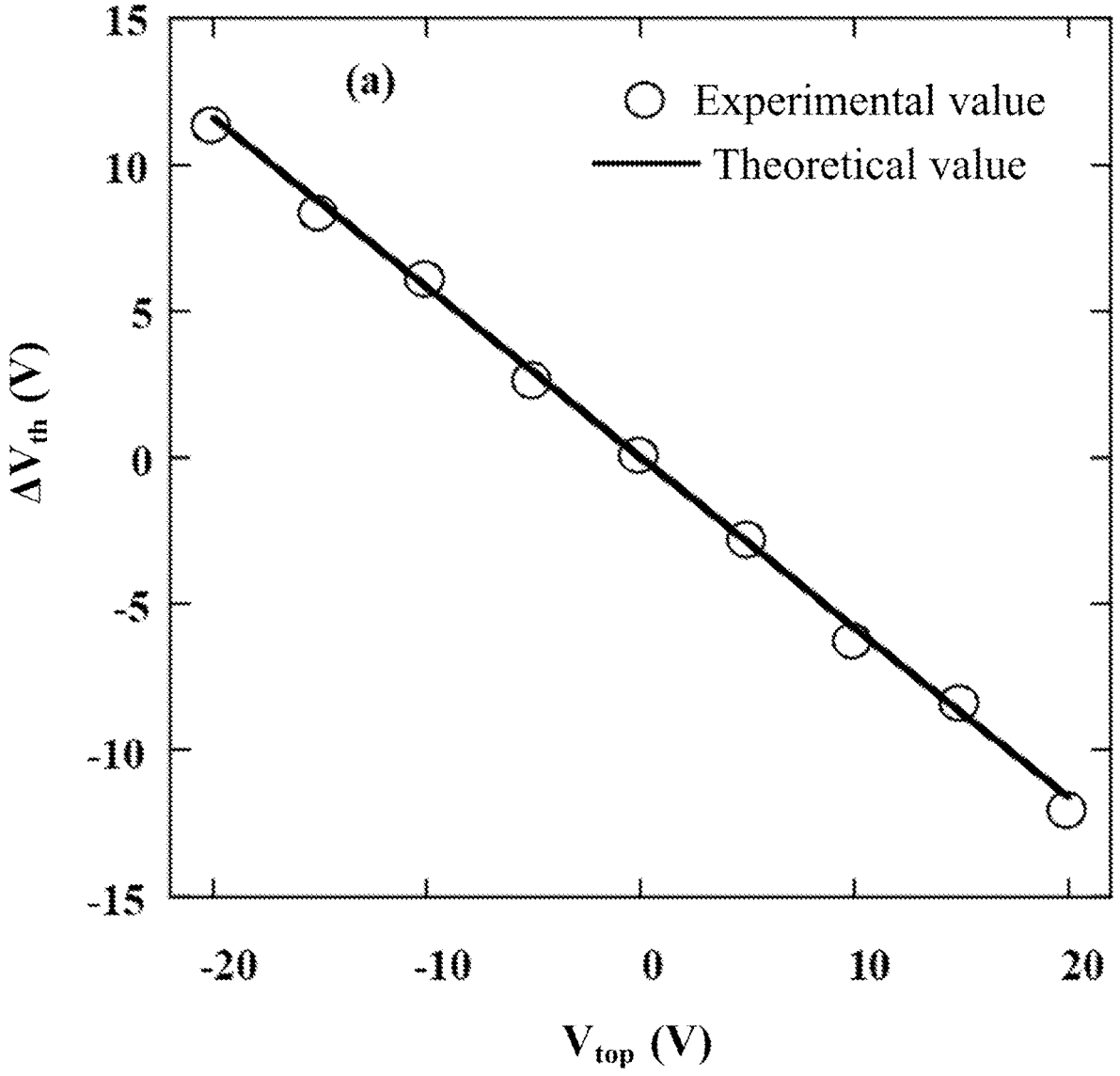
FIG. 13 is a schematic diagram of a transfer curve of applying different constant bias voltages to a top gate of a dual-gate N-type transistor when a material of a first gate insulation layer is SiNx/SiO2.
Figure 14:
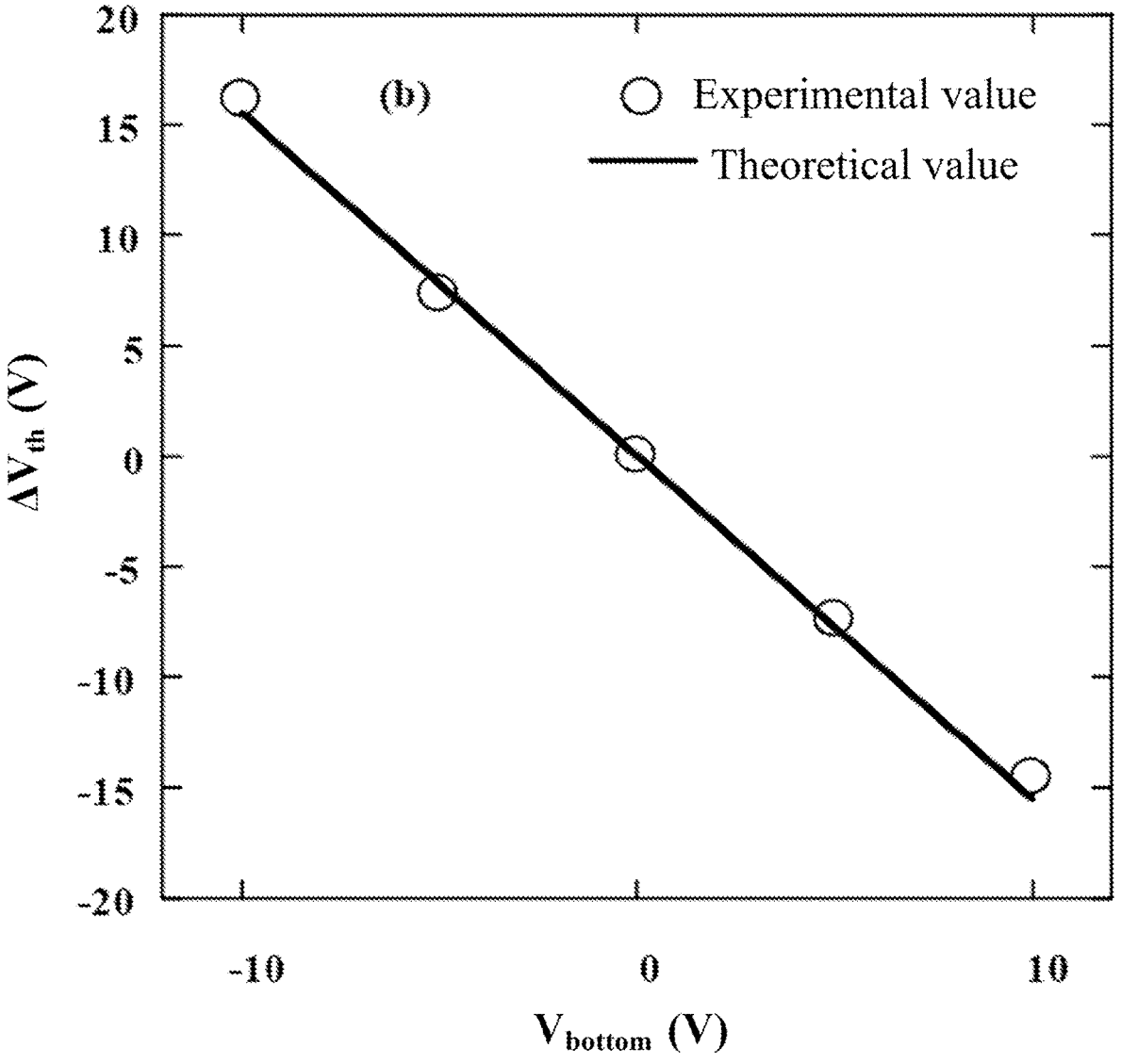
FIG. 14 is a schematic diagram of a transfer curve of applying different constant bias voltages to a bottom gate of a dual-gate N-type transistor when a material of a first gate insulation layer is SiNx/SiO2.

Table 4 shows the material and thickness of various film layers of another dual-gate N-type transistor. The difference from Table 1 is that the first gate insulation layer is made of $SiNx/SiO_2$ material. FIG. 13 is a schematic diagram of a transfer curve of applying different constant bias voltages to a top gate of a dual-gate N-type transistor when a material of a first gate insulation layer is $SiNx/SiO_2$, where the abscissa is a constant bias voltage $V_{top}$ of the top gate of the dual-gate N-type transistor, and the ordinate is the change value of the threshold voltage of dual-gate N-type transistor. A theoretical value is the change value of the threshold voltage calculated by formula (1), and the experimental value is the change value of the threshold voltage obtained by testing in the experiment. As can be seen from FIG. 13, a regulated amplitude of the threshold voltage of a dual-gate N-type transistor including the first gate insulation layer with the material of $SiNx/SiO_2$ is larger than that of the dual-gate N-type transistor of the first gate insulation layer with the material of AlOx, it is indicated that for the first gate insulation layer with the material of silicon nitride oxide, the vertical electric field generated from the top gate to the bottom gate will be obviously enhanced. FIG. 14 is a schematic diagram of a transfer curve of applying different constant bias voltages to a bottom gate of a dual-gate N-type transistor when a material of a first gate insulation layer is $SiNx/SiO_2$, where the abscissa is a constant bias voltage $V_{bottom}$ of the bottom gate of the dual-gate N-type transistor, and the ordinate is the change value of the threshold voltage of dual-gate N-type transistor. A theoretical value is the change value of the threshold voltage calculated by formula (1), and the experimental value is the change value of the threshold voltage obtained by testing in the experiment. The variation of threshold voltage is the same as that of different constant bias applied to the top gate.

TABLE 3

| | First gate | First gate insulation layer | Active layer | Second gate insulation layer | Second gate | First passivation layer | Source and drain electrode | Second passivation layer |
|---|---|---|---|---|---|---|---|---|
| Material | Mo | $SiO_2$ | Pr—IZO | $SiNx/SiO_2$ | Ti/Al/Ti | SiOx | Ti/Al/Ti | polyimide |
| Thickness | 200 nm | 150 nm | 40 nm | 100/300 nm | 50/200/50 nm | 300 nm | 50/200/50 nm | 2.1 um |

TABLE 4

| | First gate | First gate insulation layer | Active layer | Second gate insulation layer | Second gate | First passivation layer | Source and drain electrode | Second passivation layer |
|---|---|---|---|---|---|---|---|---|
| Material | Mo | $SiNx/SiO_2$ | Gd—IZO | $SiO_2$ | Mo/Al/Mo | SiOx | Mo/Al/Mo | SiNx |
| Thickness | 200 nm | 250/50 nm | 30 nm | 300 nm | 50/300/50 nm | 400 nm | 50/300/50 nm | 300 nm |

Figure 15:
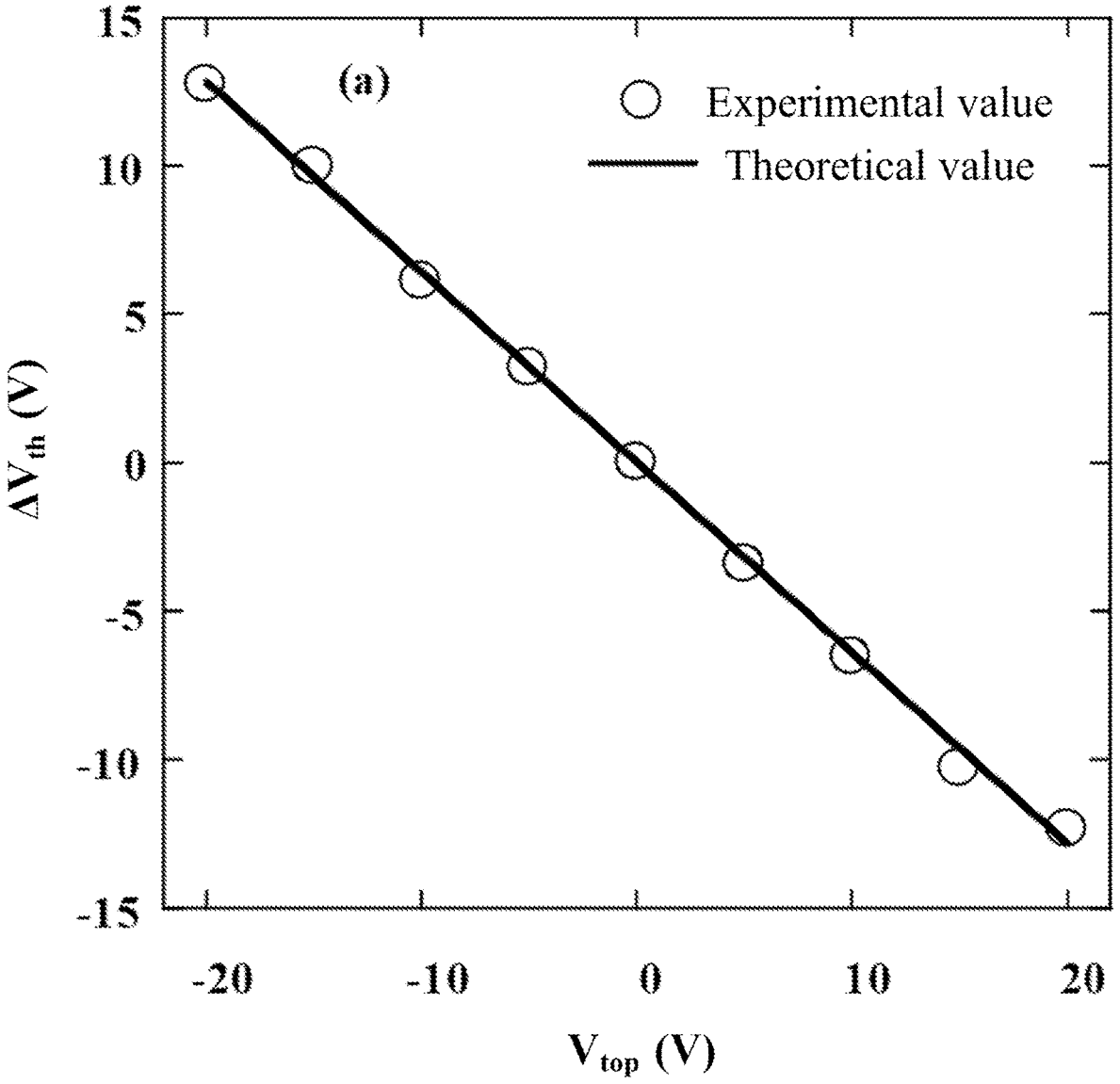
FIG. 15 is a schematic diagram of a transfer curve of applying different constant bias voltages to a top gate of a dual-gate N-type transistor when a material of a first gate insulation layer is CYTOP with a thickness of 300 nm, a thickness of an active layer is 20 nm, and the material of the second gate insulating layer is PDMS with a thickness of 600 nm.
Figure 16:
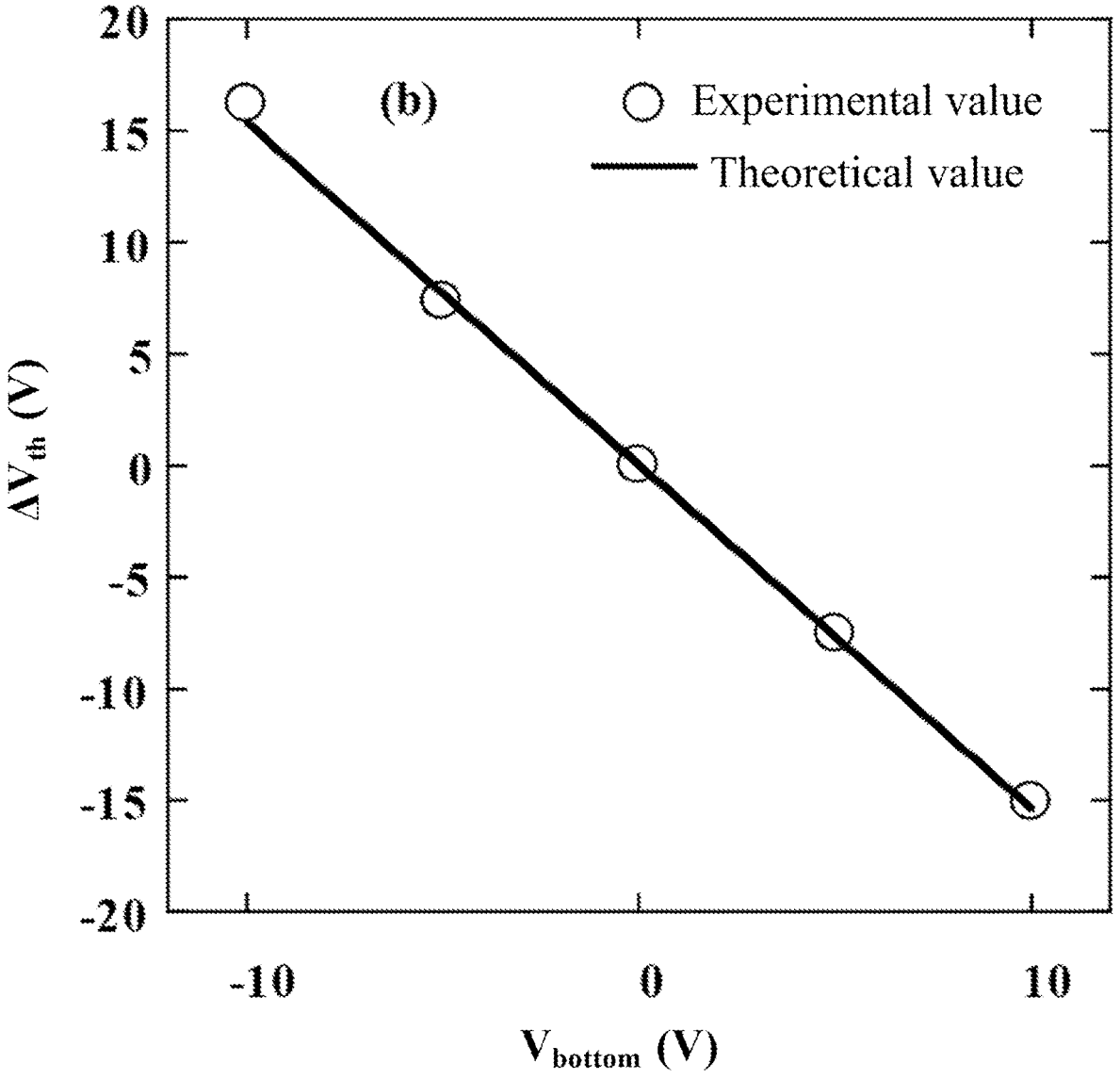
FIG. 16 is a schematic diagram of a transfer curve of applying different constant bias voltages to a bottom gate of a dual-gate N-type transistor when a material of a first gate insulation layer is CYTOP with a thickness of 300 nm, a thickness of an active layer is 20 nm, and the material of the second gate insulating layer is PDMS with a thickness of 600 nm.

Table 5 shows the material and thickness of various film layers of another dual-gate N-type transistor. The difference from Table 1 is that the material of the first gate insulation layer is CYTOP with the thickness of 300 nm, the thickness of the active layer is 20 nm, and the material of the second gate insulation layer is polydimethylsiloxane (PDMS) with the thickness of 600 nm. FIG. 15 is a schematic diagram of a transfer curve of applying different constant bias voltages to a top gate of a dual-gate N-type transistor when a material of a first gate insulation layer is CYTOP with a thickness of 300 nm, a thickness of an active layer is 20 nm, and the material of the second gate insulating layer is PDMS with a thickness of 600 nm, where the abscissa is a constant bias voltage $V_{top}$ of the top gate of the dual-gate N-type transistor, and the ordinate is the change value of the threshold voltage of dual-gate N-type transistor. A theoretical value is the change value of the threshold voltage calculated by formula (1), and the experimental value is the change value of the threshold voltage obtained by testing in the experiment. As can be seen from FIG. 15, a regulated amplitude of the threshold voltage of a dual-gate N-type transistor including the first gate insulation layer with the material of CYTOP and the thickness of 300 nm, an active layer with the thickness of 20 nm, and the second gate insulating layer with the material of is PDMS and the thickness of 600 nm is larger than that of the dual-gate N-type transistor in Table 1, it is indicated that the vertical electric field generated from the top gate to the bottom gate of the dual-gate N-type transistor in Table 5 will be obviously enhanced. FIG. 16 is a schematic diagram of a transfer curve of applying different constant bias voltages to a bottom gate of a dual-gate N-type transistor when a material of a first gate insulation layer is CYTOP with a thickness of 300 nm, a thickness of an active layer is 20 nm, and the material of the second gate insulating layer is PDMS with a thickness of 600 nm, where the abscissa is a constant bias voltage $V_{bottom}$ of the bottom gate of the dual-gate N-type transistor, and the ordinate is the change value of the threshold voltage of dual-gate N-type transistor. A theoretical value is the change value of the threshold voltage calculated by formula (1), and the experimental value is the change value of the threshold voltage obtained by testing in the experiment. The variation of threshold voltage is the same as that of different constant bias applied to the top gate.

TABLE 5

| | First gate | First gate insulation layer | Active layer | Second gate insulation layer | Second gate | First passivation layer | Source and drain electrode | Second passivation layer |
|---|---|---|---|---|---|---|---|---|
| Material | Mo | CYTOP | Yb—IZO | PDMS | Mo/Al/Mo | SiOx | graphene | SiNx |
| Thickness | 200 nm | 300 nm | 20 nm | 600 nm | 20/300/50 nm | 200 nm | 1.1 um | 300 nm |

Figure 17:
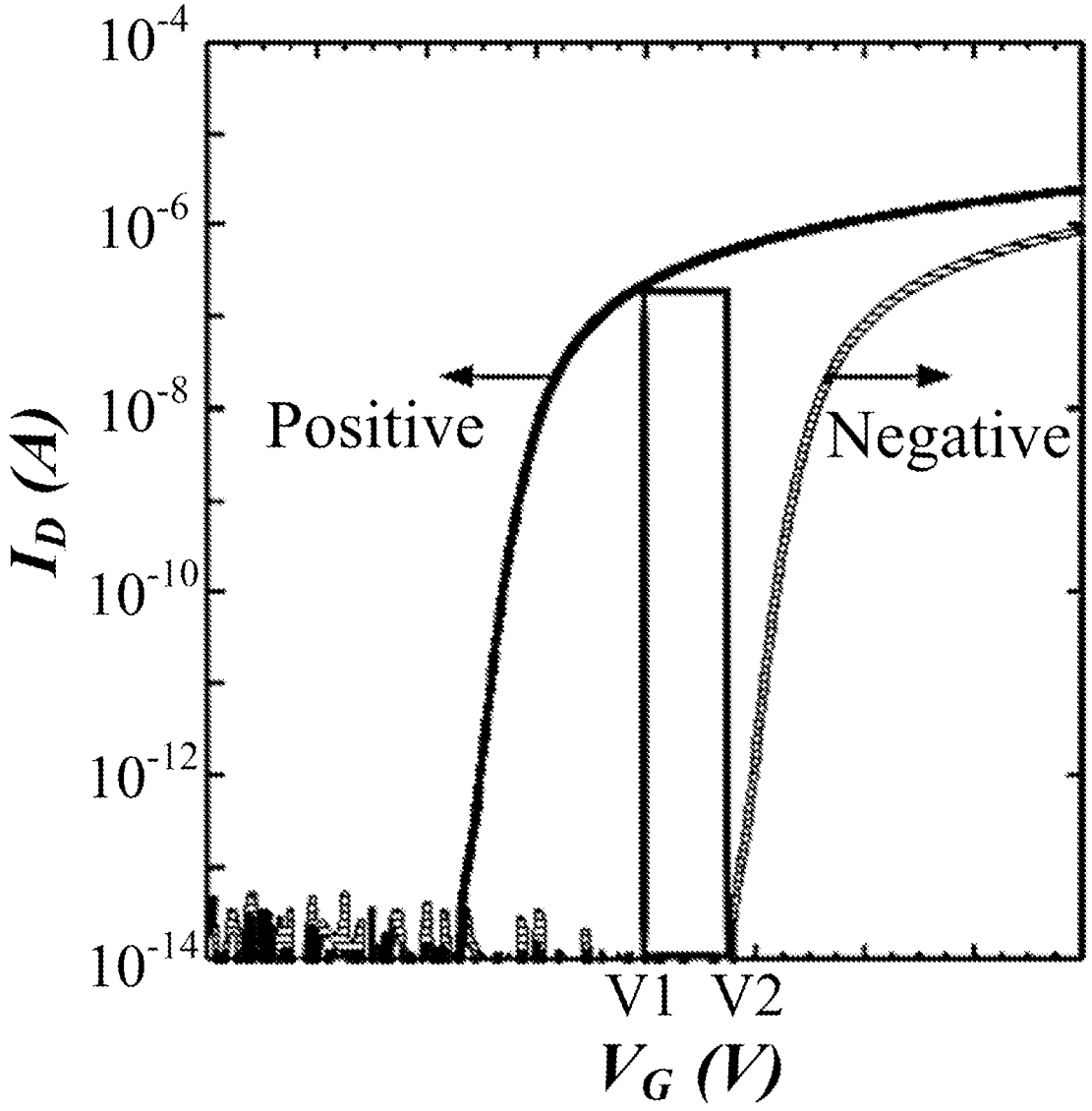
FIG. 17 is a schematic diagram of a transfer characteristic curve of a dual-gate N-type transistor.

When the drive module 130 includes the dual-gate N-type transistor, the first control terminal 131 is the first gate, and the second d control terminal 132 is the second gate. The data voltage is written into the first gate, and the PWM signal is written into the second gate. FIG. 17 is a schematic diagram of a transfer characteristic curve of a double-gate N-type transistor. The abscissa is a voltage written into the second gate, and the ordinate is a current of the dual-gate N-type transistor. As shown in FIG. 17, when the PWM signal is output at high level, the threshold voltage of the dual-gate N-type transistor shifts s in a negative direction, that is, the threshold voltage of the dual-gate N-type transistor decreases, so that the threshold voltage of the dual-gate N-type transistor is smaller than the voltage difference between the gate of the dual-gate N-type transistor and the source of the dual-gate N-type transistor, the dual-gate N-type transistor is turned on, and a drive current is generated, thereby driving the light emitting device 140 to emit light. From the current formula (2) of dual-gate N-type transistor, it can be seen that the smaller the threshold voltage of the dual-gate N-type transistor, the greater the current of the double-gate N-type transistor.

$$I_{OLED} = \frac{1}{2}\mu C_{ox}\frac{W}{L}(V_{GS} - V_{TH})^2 \tag{2}$$

$I_{OLED}$ is the current flowing through the dual-gate N-type transistor, μ is the carrier mobility of the dual-gate N-type transistor, W and L are a channel width of the dual-gate N-type transistor and a channel length of the dual-gate N-type transistor, respectively, $V_{GS}$ is the voltage difference between the gate of the dual-gate N-type transistor and the source of the double-gate N-type transistor, and VTH is the threshold voltage of the dual-gate N-type transistor.

When the PWM signal is output at a low level, the threshold voltage of the dual-gate N-type transistor shifts in a positive direction, that is, the threshold voltage of the dual-gate N-type transistor increases, so that the threshold voltage of the dual-gate N-type transistor is greater than the voltage difference between the gate of the dual-gate N-type transistor and the source of the dual-gate N-type transistor, the dual-gate N-type transistor is turned off, and a drive current is not connected, thereby the light emitting device 140 does not emit light. Therefore, it is possible to adjust the output time of the PWM signal at the high level by adjusting the duty cycle of the PWM signal, and then the light emitting time of the light emitting device 140 can be adjusted. When the light emitting time of the light emitting device 140 is adjusted through the duty cycle of the PWM signal, the first control terminal 131 of the drive module 140 maintains the data voltage, so that the data voltage does not need to be synchronized with the duty cycle of the light emitting device 140 controlled by the PWM signal, therefore, the design complexity of the driver circuit for driving the pixel circuit to work can be reduced, and then the manufacturing cost of the display panel can be reduced.

It is to be noted that the operation process of the dual-gate N-type transistor is exemplarily described above. In other embodiments, the drive module 130 may also include a dual-gate P-type transistor. When the PWM signal is output at high level, a threshold voltage of the dual-gate P-type transistor shifts in a positive direction, that is, the threshold voltage of the dual-gate P-type transistor increases, so that the threshold voltage of the dual-gate P-type transistor is greater than a voltage difference between a gate of the dual-gate P-type transistor and a source of the dual-gate P-type transistor, the dual-gate P-type transistor is turned off, and a drive current is not generated, thereby the light emitting device 140 does not emit light. When the PWM signal is output at a low level, a threshold voltage of the dual-gate P-type transistor shifts in a negative direction, that is, the threshold voltage of the dual-gate P-type transistor decreases, so that the threshold voltage of the dual-gate P-type transistor is smaller than a voltage difference between a gate of the dual-gate P-type transistor and a source of the dual-gate P-type transistor, the dual-gate P-type transistor is turned on, and a drive current is generated, thus driving the light emitting device 140 to emit light.

Figure 18:
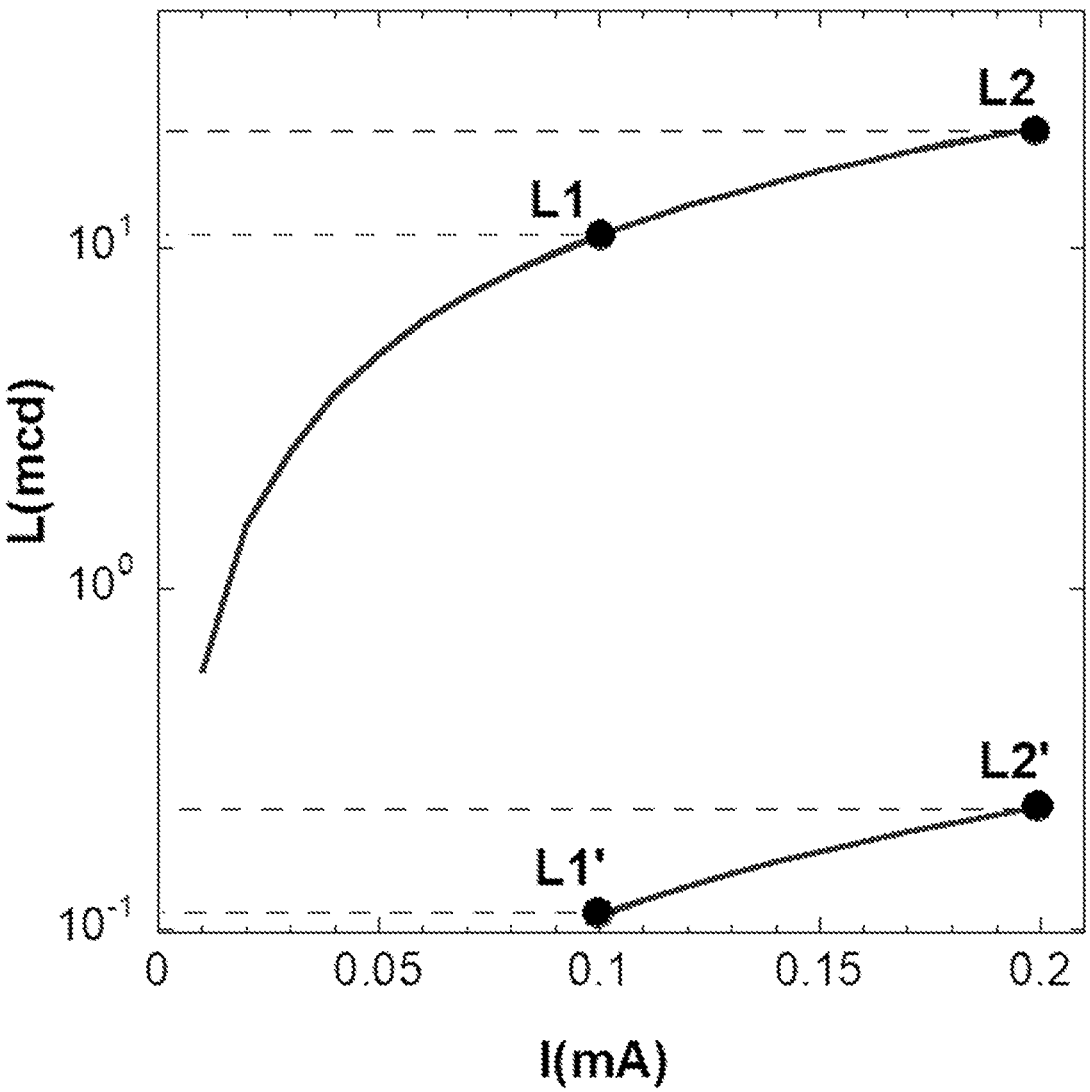
FIG. 18 is a curve diagram of a relationship between light intensity and a current of a PWM signal modulated light emitting device with a duty cycle of 1% according to the embodiment of the present application.

In addition, the luminance of the light emitting device 140 is the average luminance of the light emitting device 140 in one cycle of the PWM signal. For example, if the drive current flowing through the light emitting device 140 is $I_0$, the corresponding luminance is $L_0$, and if the duty cycle of the PWM signal is $\eta$, the luminance L of the light emitting device 140 is $L=L_0*\eta$. Therefore, the light emitting device 140 can be made to emit light with a stable color under the higher luminous efficiency. Then the average luminance of the light emitting device 140 is adjusted by adjusting the duty cycler $\eta$ of the PWM signal, so that the average luminance of the light emitting device 140 is in a reasonable range, and the corresponding relationship between the luminance of the light-emitting device 140 and the grayscale level is satisfied. Exemplarily, FIG. 18 is a curve diagram of a relationship between light intensity and a current of a PWM signal modulated light emitting device with a duty cycle of 1% according to the embodiment of the present application. The abscissa is a current I flowing through the light emitting device, and the ordinate is the luminous intensity L of the light emitting device. A curve L1L2 is the luminous intensity before the PWM signal modulates the light emitting device, and a curve L1'L2' is the luminous intensity after the PWM signal modulates the light emitting device. As can be seen from curves L1L2 and L1'L2', the light emitting device works in a drive current region with high luminous efficiency and stable light emitting color, and then the luminance of the light emitting device corresponds to the low current and the low grayscale level through a PWM signal modulation, so that the luminance corresponding to different grayscale level can be satisfied when the light emitting device works in a region with high luminous efficiency and stable luminous color.

In a solution of this embodiment, the PWM signal is provided to the second control terminal of the drive module through the PWM signal input terminal, so that the drive module provides discontinuous drive current to the light emitting device, thereby controlling the light emitting time of the light emitting device. When the light emitting time of the light emitting device 140 is adjusted through the duty cycle of the PWM signal, the first control terminal of the drive module maintains the data voltage, so that the data voltage does not need to be synchronized with the duty cycle of the light emitting device controlled by the PWM signal, therefore, the design complexity of the driver circuit for driving the pixel circuit to work can be reduced, and then the manufacturing cost of the display panel can be reduced. At the same time, the light emitting device works in a drive current region with high luminous efficiency and stable light emitting color, and the luminance of the light emitting device corresponds to the low current and the low grayscale level through a PWM signal modulation, so that the luminance corresponding to different grayscale level can be satisfied when the light emitting device works in a region with high luminous efficiency and stable luminous color.

Exemplarily, referring to FIG. 3, the first terminal of the data write module 110 is electrically connected to the data signal input terminal Vdata of the pixel circuit, the second terminal of the data write module 110 is electrically connected to the first control terminal 131 of the drive module 130 and the first terminal of the storage module 120, and the control terminal of the data write module 110 is electrically connected to the scanning signal input terminal Scan1 of the pixel circuit. The first terminal of the drive module 130 is electrically connected to the first power supply input terminal VDD of the pixel circuit and the second terminal of the storage module 120, the second terminal of the drive module 130 is electrically connected to the anode of the light emitting device 140, and the cathode of the light emitting device 140 is electrically connected to the second power supply input terminal VS S of the pixel circuit.

At a data write stage, the data signal input from Vdata controlled by the Scan1 of the pixel circuit is written into the first control terminal 131 of the drive module 130 through the data write module 110, and the data signal of the first control terminal 131 is maintained through the storage module 120.

At a light emission stage, Scan1 of the pixel circuit controls the data write module 110 to stop writing the data voltage, and the PWM signal of Vpwm controls the drive module 130 to provide the discontinuous current, thereby controlling the light emitting time of the light emitting device 140.

Figure 19:
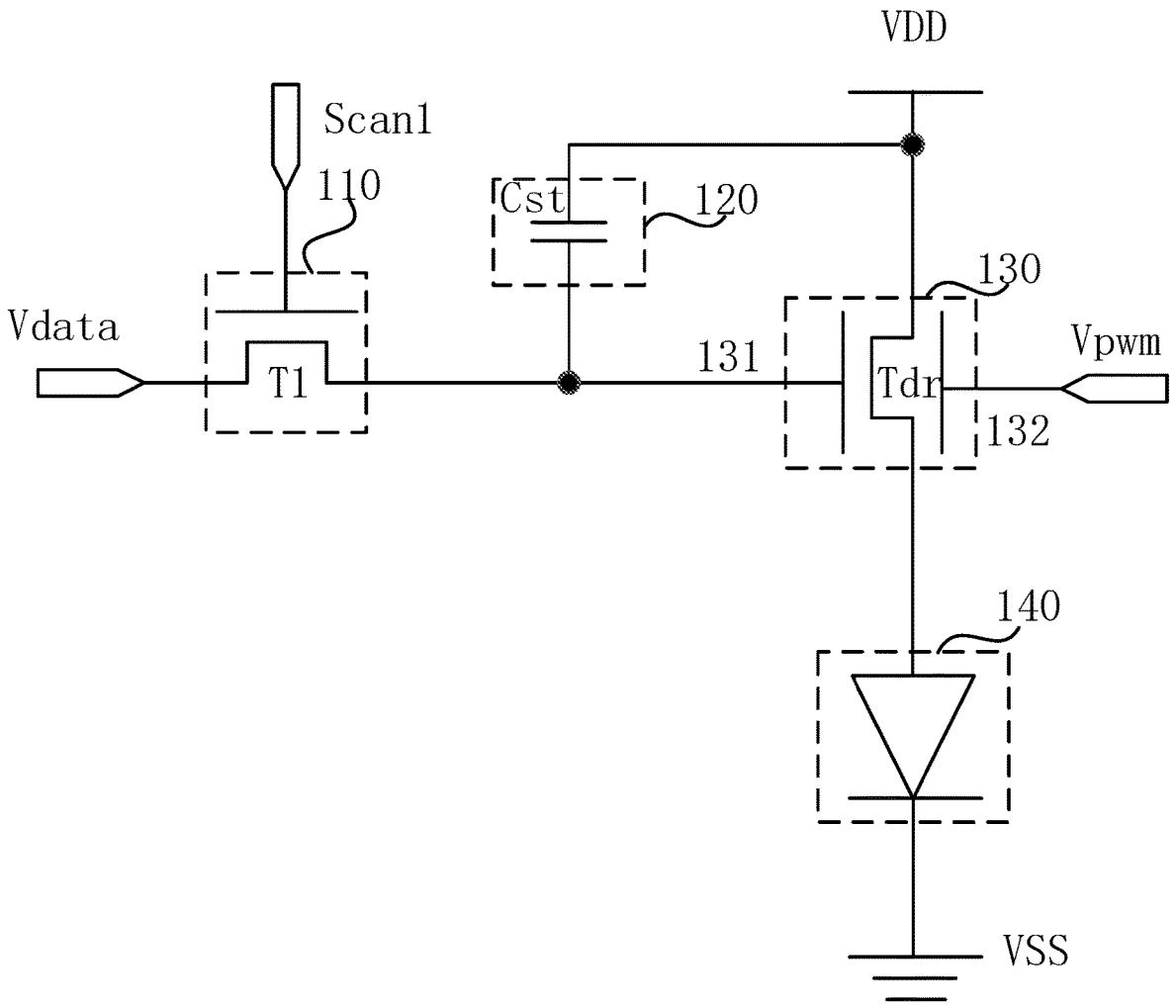
FIG. 19 is a structure diagram of another pixel circuit according to an embodiment of the present application.

FIG. 19 is a structure diagram of another pixel circuit according to an embodiment of the present application. As shown in FIG. 19, the data write module 110 includes a first transistor T1, the storage module 120 includes a storage capacitor Cst, and the drive module 130 includes a drive transistor Tdr. The gate of the first transistor T1 is a control terminal of the data write module 110, the first electrode of the first transistor T1 is the first terminal of the data write module 110, the second electrode of the first transistor T1 is the second terminal of the data write module 110, the first electrode of the storage capacitor Cst is the first terminal of the storage module 120, and the second electrode of the storage capacitor Cst is the second terminal of the storage module 120. The drive transistor Tdr is a dual-gate transistor. The first electrode of the dual-gate transistor is the first terminal of the drive module 130, and the second electrode of the dual-gate transistor is the second terminal of the drive module 130. The bottom gate of the dual-gate transistor is the first control terminal of the drive module 130, and the top gate of the dual-gate transistor is the second control terminal of the drive module 130, or the top gate of the dual-gate transistor is the first control terminal of the drive transistor 130, and the bottom gate of the dual-gate transistor is the second control terminal of the drive module 130.

Figure 20:
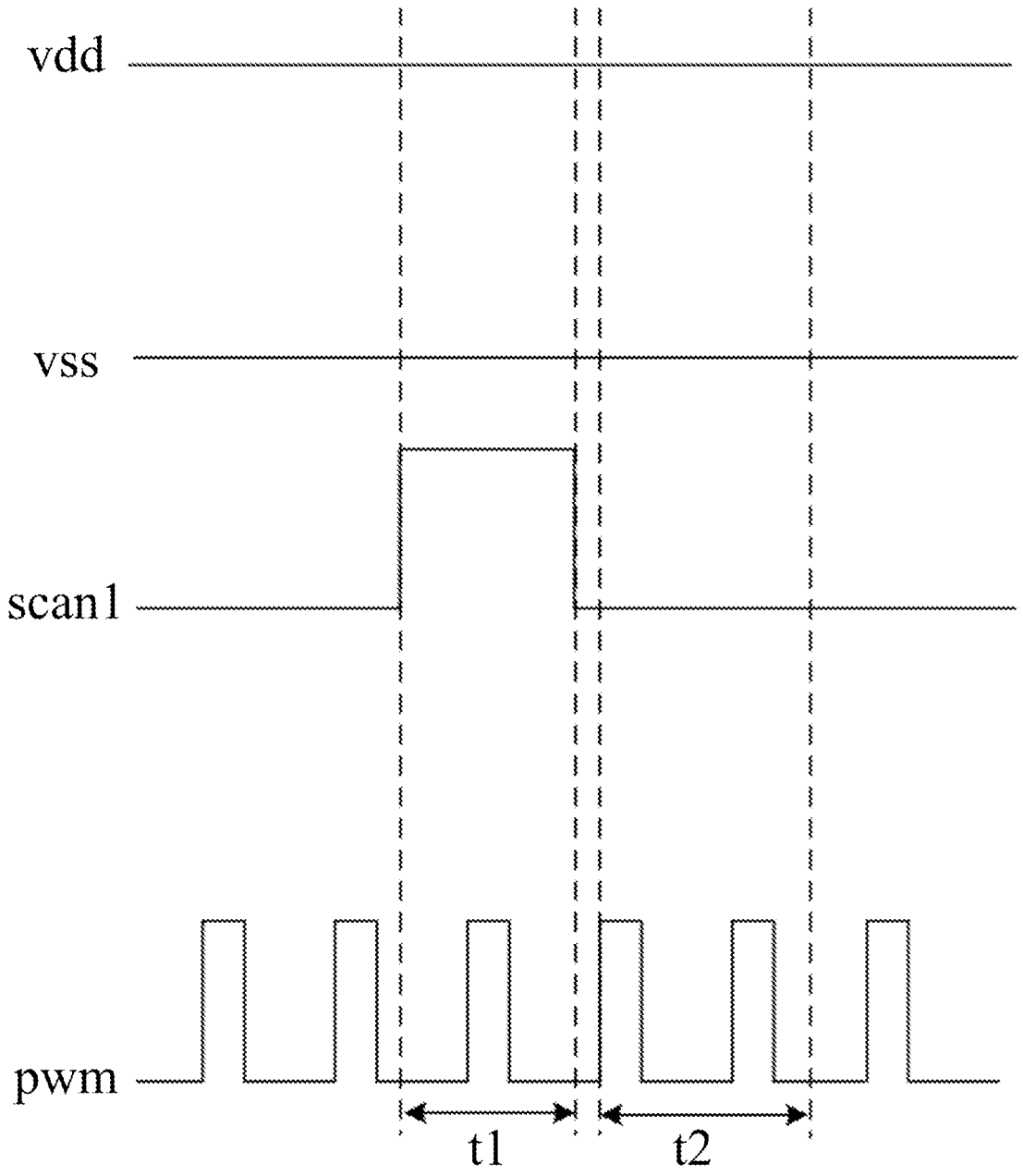
FIG. 20 is a timing diagram of a pixel circuit in FIG. 19.

Exemplarily, FIG. 20 is a timing diagram of a pixel circuit in FIG. 19. scan1 is the timing of the scanning signal input from Scan1, vdd is the timing of the first power supply signal input from VDD, vss is the timing of the second power signal input from VSS, and pwm is the timing of the PWM signal input from Vpwm. The working principle of the pixel circuit is expressed below in conjunction with FIG. 19 and FIG. 20.

At a first stage t1, scan1 is at high level, the first transistor T1 is turned on, the data voltage is written into the gate of the drive transistor Tdr through the first transistor T1, and the data voltage is maintained through the storage capacitor Cst.

At a second stage t2, scan1 is at high level, the first transistor T1 is turned off. At the same time, the first gate of the drive transistor Tdr is at the high level. When the pwm signal is at the high level, the drive transistor Tdr is turned on. When the pwm signal is the low level, the drive transistor Tdr is turned off. Therefore, the on time of the drive transistor Tdr is controlled by the duty cycle of the pwm signal, and the duty cycle of the pwm signal t can control the time when the drive transistor Tdr provides the drive current to the light emitting device 140, thereby controlling the light emitting time of the light emitting device 140.

It is to be noted that the drive current of the drive transistor Tdr is related to the value of the data voltage. As shown in FIG. 19, when the drive transistor Tdr is an N-type transistor, the larger the data voltage, the larger the drive current output by the drive transistor Tdr, and the brighter the luminance of the corresponding light emitting device 140. The smaller the data voltage, the smaller the drive current output by the drive transistor Tdr, and the darker the luminance of the corresponding light emitting device 140.

Figure 21:
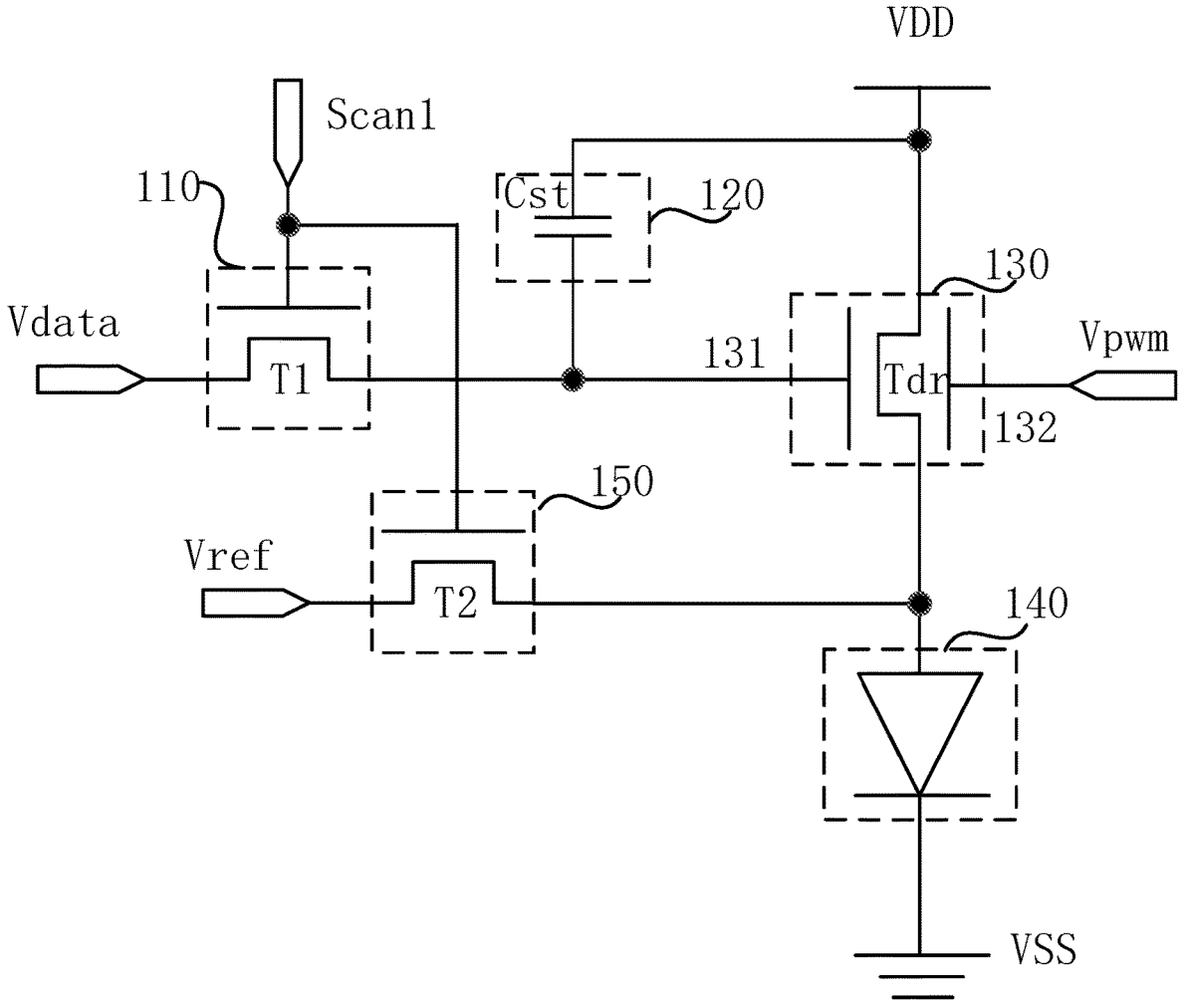
FIG. 21 is a structure diagram of another pixel circuit according to an embodiment of the present application.

FIG. 21 is a structure diagram of another pixel circuit according to an embodiment of the present application. As shown in FIG. 21, the pixel circuit further includes a reset module 150. The control terminal of the reset module 150 is electrically connected to a scanning signal input terminal Scan1 of the pixel circuit, the first terminal of the reset module 150 is electrically connected to a reference signal input terminal Vref, the second terminal of the reset module 150 is electrically connected to an anode of the light emitting device 140, and the reset module 150 is configured to reset the light emitting device 140.

Exemplarily, the reset module 150 resets the anode of the light emitting device 140 while the data write module 110 writes the data voltage into the drive module 130, so as to avoid the residual voltage after the light emitting device 140 emits light in the previous frame affecting the luminance of the light emitting device 140 in the current frame.

Exemplarily, referring to FIG. 21, the reset module 150 includes a second transistor T2. The gate of the second transistor T2 is the control terminal of the reset module 150, the first electrode of the second transistor T2 is the first terminal of the reset module 150, and the second electrode of the second transistor T2 is the second terminal of the reset module 150.

Figure 22:
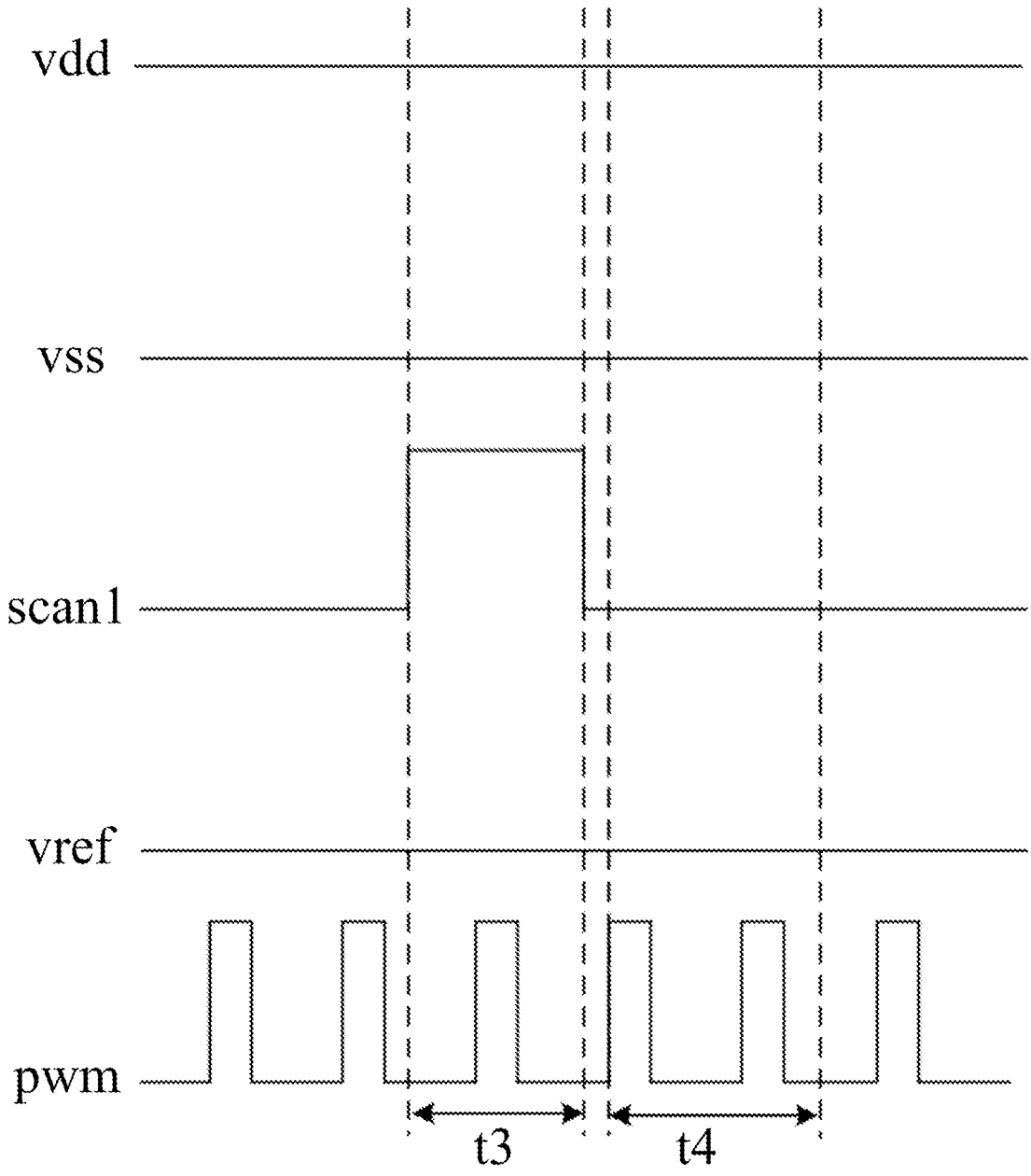
FIG. 22 is a timing diagram of a pixel circuit in FIG. 21.

Exemplarily, FIG. 22 is a timing diagram of a pixel circuit in FIG. 21. vref is the timing of the reference signal provided by Vref. The working process of the pixel circuit is expressed in conjunction with FIG. 21 and FIG. 22.

At a reset stage and the data write stage t3, scan1 is at high level, the first transistor T1 and the second transistor T2 are turned on, the data voltage is written into the gate of the drive transistor Tdr through the first transistor T1, and the data voltage is maintained through the storage capacitor Cst. The reference signal vref input from the reference signal input terminal Vref is written to the anode of the light emitting device 140 through the second transistor T2, and the light emitting device 140 is reset.

At the light emission stage t4, scan1 is at high level, and the first transistor T1 and the second transistor T2 are turned off. At the same time, the first gate of the drive transistor Tdr is at the high level. When the pwm signal is at the high level, the drive transistor Tdr is turned on. When the pwm signal is at low level, the drive transistor Tdr is turned off. Therefore, the on time of the drive transistor Tdr is controlled by the duty cycle of the pwm signal, the duty cycle of the pwm signal can control the time when the drive transistor Tdr provides the drive current to the light emitting device 140, thereby controlling the light emitting time of the light emitting device 140.

Figure 23:
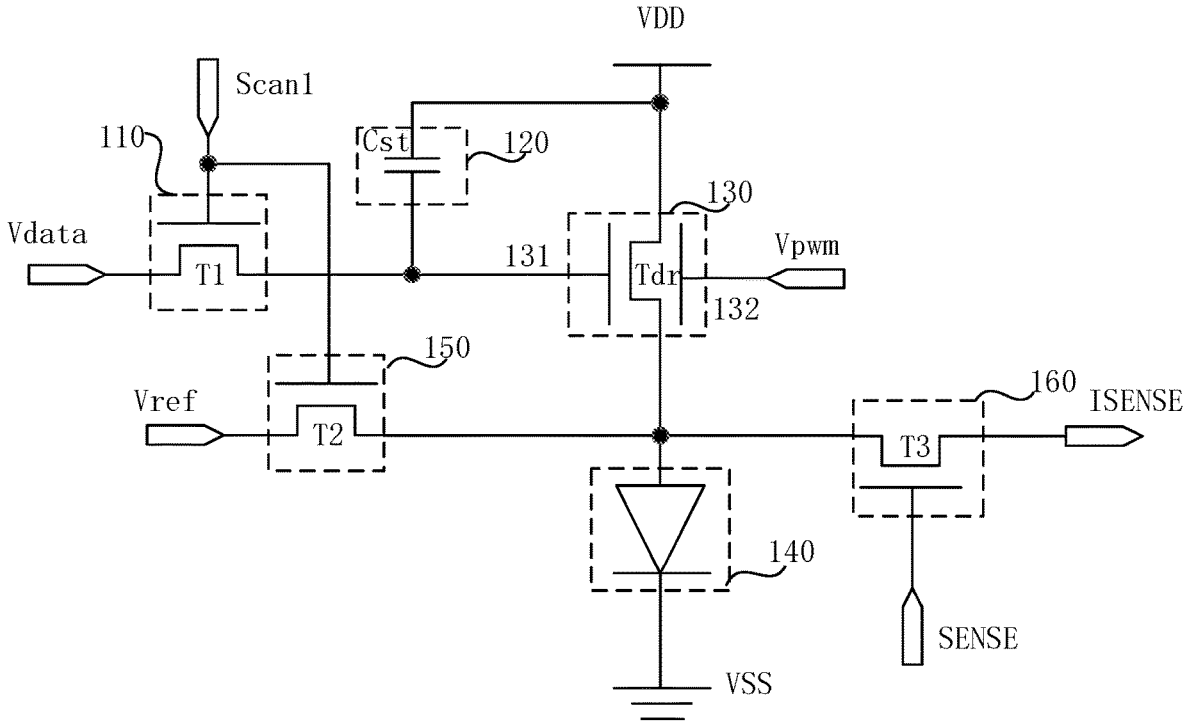
FIG. 23 is a structure diagram of another pixel circuit according to an embodiment of the present application.

FIG. 23 is a structure diagram of another pixel circuit according to an embodiment of the present application. As shown in FIG. 23, the pixel circuit further includes a sensor module 160. A control terminal of the sensor module 160 is electrically connected to a sensing control signal input terminal SENSE of the pixel circuit, a first terminal of the sensor module 160 is electrically connected to an anode of the light emitting device 140, a second terminal of the sensor module 160 is electrically connected to a sensing signal output terminal ISENSE, and the sensor module 160 is configured to sense a potential of the light emitting device 140.

Exemplarily, before the light emission stage, the sensing control signal turns on the sensor module 160, the current of the drive module 130 is output to ISENSE and is output to an external sensor circuit through ISENSE, and the external sensor circuit compensates the pixel circuit according to the current flowing through the drive module 130.

Exemplarily, referring to FIG. 23, the sensor module includes a third transistor T3. The gate of the third transistor T3 is the control terminal of the sensor module 160, the first electrode of the third transistor T3 is the first terminal of the sensor module 160, and the second electrode of the third transistor T3 is the second terminal of the sensor module 160.

Figure 24:
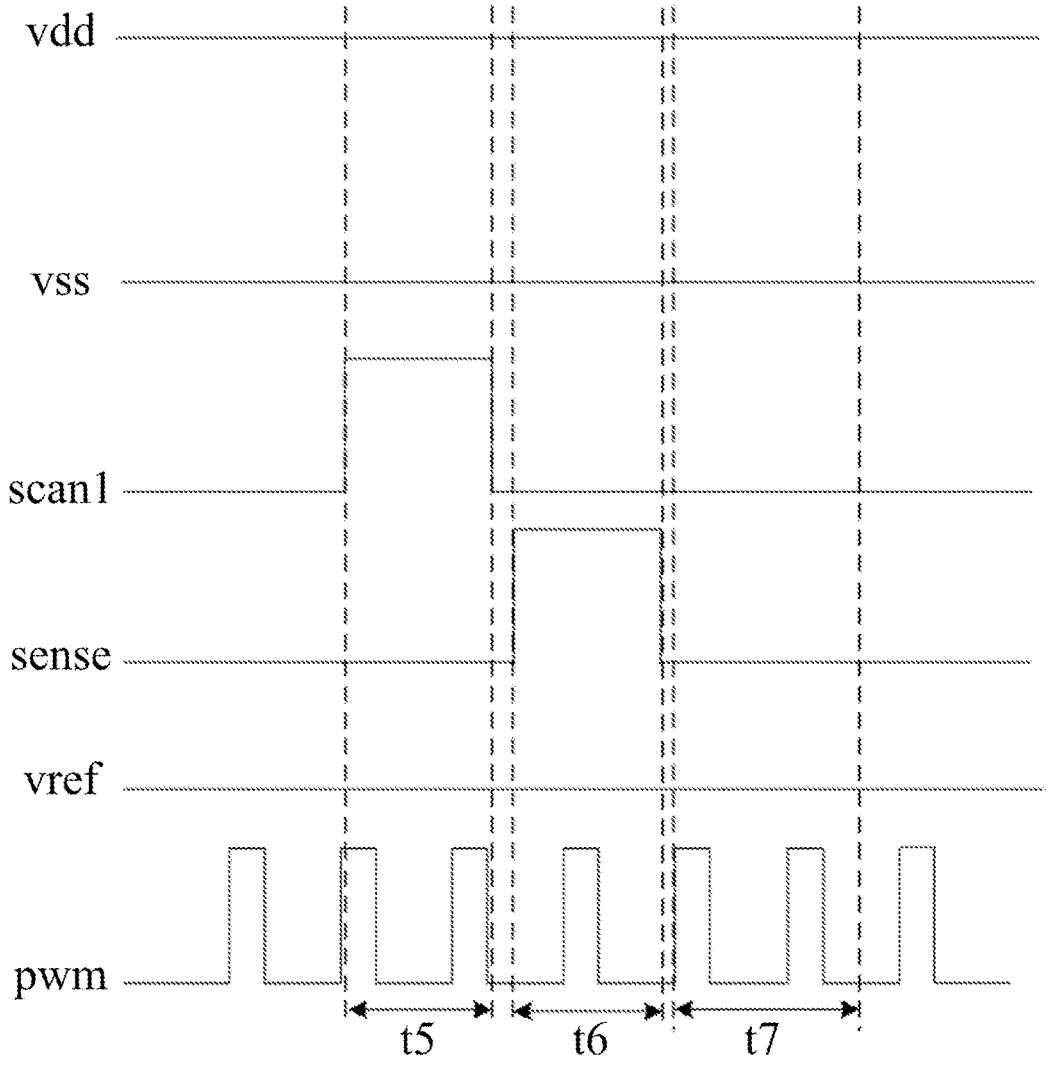
FIG. 24 is a timing diagram of a pixel circuit in FIG. 23.

Exemplarily, FIG. 24 is a timing diagram of a pixel circuit in FIG. 23, where sense is the timing of the sensing control signal output from SENSE. The working process of the pixel circuit is expressed in conjunction with FIG. 23 and FIG. 24.

At a reset stage and the data write stage t5, scan1 is at high level, the first transistor T1 and the second transistor T2 are turned on, the data voltage is written into the gate of the drive transistor Tdr through the first transistor T1, and the data voltage is maintained through the storage capacitor Cst. The reference signal vref input from the reference signal input terminal Vref is written to the anode of the light emitting device 140 through the second transistor T2, and the light emitting device 140 is reset.

At the sensing stage T6, the sensing control signal sense output from the sensing control signal input terminal SENSE is at high level, the third transistor T3 is turned on, and the current of the drive transistor Tdr is output to the external sensing circuit through the third transistor T3. The external circuit adds a compensation signal to the data voltage through data processing, thereby improving the luminous uniformity of the whole display panel.

At the light emission stage t7, scan1 is at high level, and the first transistor T1 and the second transistor T2 are turned off. At the same time, the first gate of the drive transistor Tdr is at the high level. When the pwm signal is at the high level, the drive transistor Tdr is turned on. When the pwm signal is at the low level, the drive transistor Tdr is turned off. Therefore, the on time of the drive transistor Tdr is controlled by the duty cycle of the pwm signal, the duty cycle of the pwm signal can control the time when the drive transistor Tdr provides the drive current to the light emitting device 140, thereby controlling the light emitting time of the light emitting device 140.

Figure 25:
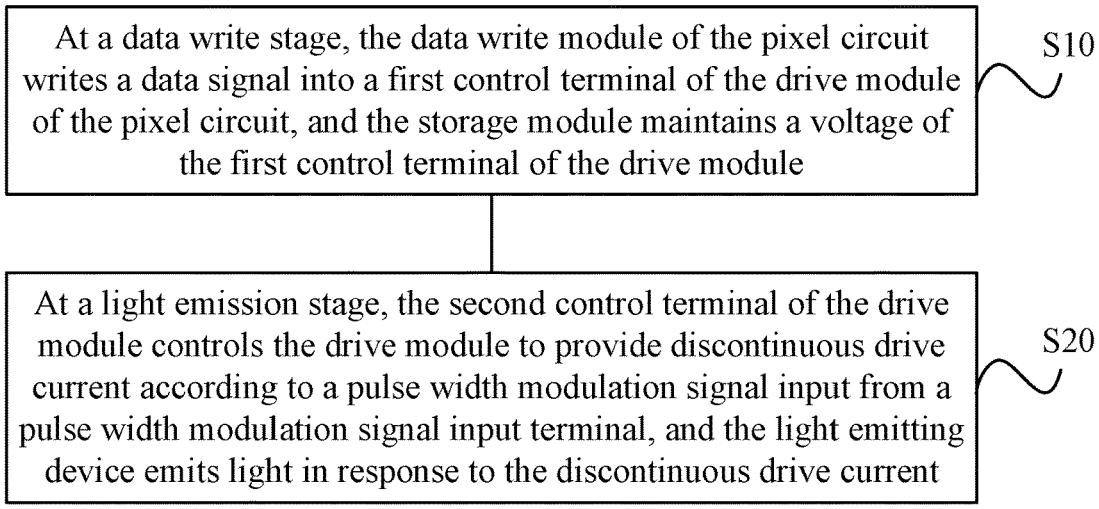
FIG. 25 is a flowchart of a method for driving a pixel circuit according to an embodiment of the present application.

A method for driving a pixel circuit is further provided in the embodiment of the present application and used for driving the pixel circuit provided by various solutions. FIG. 25 is a flowchart of a method for driving a pixel circuit according to an embodiment of the present application. As shown in FIG. 25, the method includes steps S10 to S20.

In step S10, at a data write stage, the data write module of the pixel circuit writes a data signal into a first control terminal of the drive module of the pixel circuit, and the storage module maintains a voltage of the first control terminal of the drive module.

In step S20, at a light emission stage, the second control terminal of the drive module controls the drive module to provide discontinuous drive current according to a PWM signal input from a PWM signal input terminal, and the light emitting device emits light in response to the discontinuous drive current.

In the solution of this embodiment, at the data write stage, the data signal is written into the first control terminal of the drive module, and the storage module maintains the voltage of the first control terminal of the drive module, so that the voltage of the first control terminal is maintained at the data signal. Then at the light emission stage, the PWM signal is provided to the second control terminal of the drive module, so that the drive module provides discontinuous drive current to the light emitting device, thereby controlling the light emitting time of the light emitting device. When the light emitting time of the light emitting device 140 is adjusted through the duty cycle of the PWM signal, the first control terminal of the drive module maintains the data voltage, so that the data voltage does not need to be synchronized with the duty cycle of the light emitting device controlled by the PWM signal, therefore, the design complexity of the driver circuit for driving the pixel circuit to work can be reduced, and then the manufacturing cost of the display panel can be reduced. At the same time, the light emitting device works in a drive current region with high luminous efficiency and stable light emitting color, and the luminance of the light emitting device corresponds to the low current and the low grayscale level through a PWM signal modulation, so that the luminance corresponding to different grayscale levels can be satisfied when the light emitting device works in a region with high luminous efficiency and stable luminous color.

Figure 26:
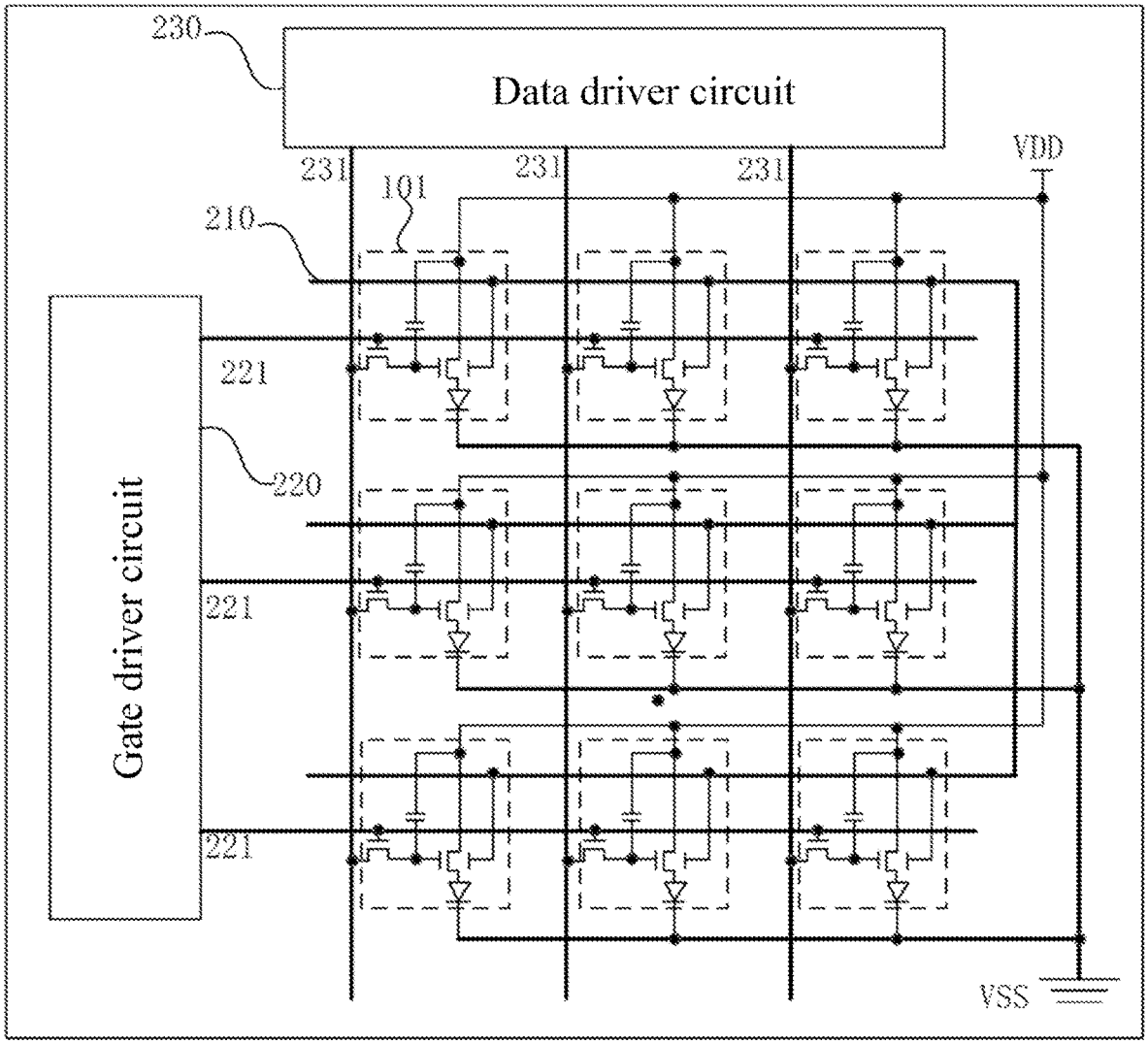
FIG. 26 is a structure diagram of a display panel according to an embodiment of the present application.

An embodiment of the present application further provides a display panel. FIG. 26 is a structure diagram of a display panel according to an embodiment of the present application. As shown in FIG. 26, the display panel includes the pixel circuit 101 provided in any embodiment of the present application.

Referring to FIG. 26, the display panel further includes a PWM signal line 210, a gate driver circuit 220 and a data driver circuit 230. The pixel circuit 101 includes a scanning signal input terminal, a data signal input terminal and a PWM signal input terminal, the PWM signal line 210 is electrically connected to the PWM signal input terminal, an output terminal 221 of the gate driver circuit 220 is electrically connected to the scanning signal input terminal of the pixel circuit, and an output terminal 231 of the data driver circuit 230 is electrically connected to the data signal input terminal of the pixel circuit.

Exemplarily, the PWM signal line 210 is configured to output a PWM signal to provide the PWM signal to the PWM signal input terminal of the pixel circuit. The output terminal 221 of the gate driver circuit 220 is electrically connected to the scanning signal input terminal of the pixel circuit 101 through the scan line to provide a scanning signal to the pixel circuit 101 line by line, and the pixel circuit 101 is driven line by line. The output terminal 231 of the data driver Circuit 230 is electrically connected to the data signal input terminal of the pixel circuit 101 through the data signal line to provide the data signal to the pixel circuit 101. The pixel circuit 101 can connected to a data signal line corresponding to and electrically connected to the pixel circuit 101 under the action of the scanning signal input from the scan line electrically connected to the pixel circuit 101, and the data signal line transmits the data signal to the corresponding pixel driver circuit 101, thereby achieving a display function of the display apparatus.

What is claimed is:

1. A pixel circuit, comprising a data write module, a storage module, a drive module and a light emitting device; wherein the drive module comprises a first control terminal and a second control terminal; the data write module is configured to write, at a data write stage, a data signal into the first control terminal of the drive module, the storage module is configured to maintain a potential of the first control terminal, the second control terminal is electrically connected to a pulse-width modulation (PWM) signal input terminal of the pixel circuit, and is configured to control the drive module to provide discontinuous drive current according to a PWM signal input from the PWM signal input terminal at a light emission stage, and the light emitting device emits light in response to the discontinuous drive current.

2. The pixel circuit of claim 1, wherein a first terminal of the data write module is electrically connected to a data signal input terminal of the pixel circuit, a second terminal of the data write module is electrically connected to the first control terminal of the drive module and a first terminal of the storage module, and a control terminal of the data write module is electrically connected to a scanning signal input terminal of the pixel circuit; and a first terminal of the drive module is electrically connected to a first power supply input terminal of the pixel circuit and a second terminal of the storage module, a second terminal of the drive module is electrically connected to an anode of the light emitting device, and a cathode of the light emitting device is electrically connected to a second power supply input terminal of the pixel circuit.

3. The pixel circuit of claim 2, wherein the data write module comprises a first transistor, the storage module comprises a storage capacitor, and the drive module comprises a drive transistor;

a gate of the first transistor is the control terminal of the data write module, a first electrode of the first transistor is the first terminal of the data write module, a second electrode of the first transistor is the second terminal of the data write module, a first electrode of the storage capacitor is the first terminal of the storage module, and a second electrode of the storage capacitor is the second terminal of the storage module; and the drive transistor is a dual-gate transistor, wherein a first electrode of the dual-gate transistor is the first terminal of the drive module, and a second electrode of the dual-gate transistor is the second terminal of the drive module; and a bottom gate of the dual-gate transistor is the first control terminal of the drive module and a top gate of the dual-gate transistor is the second control terminal of the drive module, or a top gate of the dual-gate transistor is the first control terminal of the drive transistor, and a bottom gate of the dual-gate transistor is the second control terminal of the drive module.

4. The pixel circuit of claim 1, further comprising: a reset module, wherein a control terminal of the reset module is electrically connected to a scanning signal input terminal of the pixel circuit, a first terminal of the reset module is electrically connected to a reference signal input terminal, and a second terminal of the reset module is electrically connected to an anode of the light emitting device, and the reset module is configured to reset the light emitting device.

5. The pixel circuit of claim 4, wherein the reset module comprises a second transistor, wherein a gate of the second transistor is the control terminal of the reset module, a first electrode of the second transistor is the first terminal of the reset module, and a second electrode of the second transistor is the second terminal of the reset module.

6. The pixel circuit of claim 1, further comprising: a sensor module, wherein a control terminal of the sensor module is electrically connected to a sensing control signal input terminal of the pixel circuit, a first terminal of the sensor module is electrically connected to an anode of the light emitting device, a second terminal of the sensor module is electrically connected to a sensing signal output terminal, and the sensor module is configured to sense a potential of the light emitting device.

7. The pixel circuit of claim 6, wherein the sensor module comprises a third transistor, wherein a gate of the third transistor is the control terminal of the sensor module, a first electrode of the third transistor is the first terminal of the sensor module, and a second electrode of the third transistor is the second terminal of the sensor module.

8. A method for driving a pixel circuit, wherein the pixel circuit comprises a data write module, a storage module, a drive module and a light emitting device, wherein the drive module comprises a first control terminal and a second control terminal; wherein the method comprises:

at a data write stage, writing, by the data write module of the pixel circuit, a data signal into a first control terminal of the drive module of the pixel circuit, and maintaining, by the storage module, a voltage of the first control terminal of the drive module; and at a light emission stage, controlling, by the second control terminal of the drive module, the drive module to provide discontinuous drive current according to a PWM signal input from a PWM signal input terminal, and emitting, by the light emitting device, light in response to the discontinuous drive current.

9. A display panel, comprising a pixel circuit, wherein the pixel circuit, comprises a data write module, a storage module, a drive module and a light emitting device; wherein the drive module comprises a first control terminal and a second control terminal; the data write module is configured to write, at a data write stage, a data signal into the first control terminal of the drive module, the storage module is configured to maintain a potential of the first control terminal, the second control terminal is electrically connected to a pulse-width modulation (PWM) signal input terminal of the pixel circuit, and is configured to control the drive module to provide discontinuous drive current according to a PWM signal input from the PWM signal input terminal at a light emission stage, and the light emitting device emits light in response to the discontinuous drive current.

10. The display panel of claim 9, further comprising a PWM signal line, a gate driver circuit and a data driver circuit, wherein the pixel circuit comprises a scanning signal input terminal, a data signal input terminal and a PWM signal input terminal, the PWM signal line is electrically connected to the PWM signal input terminal, an output terminal of the gate driver circuit is electrically connected to the scanning signal input terminal of the pixel circuit, and an output terminal of the data driver circuit is electrically connected to the data signal input terminal of the pixel circuit.

11. The display panel of claim 9, wherein a first terminal of the data write module is electrically connected to a data signal input terminal of the pixel circuit, a second terminal of the data write module is electrically connected to the first control terminal of the drive module and a first terminal of the storage module, and a control terminal of the data write module is electrically connected to a scanning signal input terminal of the pixel circuit; and a first terminal of the drive module is electrically connected to a first power supply input terminal of the pixel circuit and a second terminal of the storage module, a second terminal of the drive module is electrically connected to an anode of the light emitting device, and a cathode of the light emitting device is electrically connected to a second power supply input terminal of the pixel circuit.

12. The display panel of claim 11, wherein the data write module comprises a first transistor, the storage module comprises a storage capacitor, and the drive module comprises a drive transistor;

a gate of the first transistor is the control terminal of the data write module, a first electrode of the first transistor is the first terminal of the data write module, a second electrode of the first transistor is the second terminal of the data write module, a first electrode of the storage capacitor is the first terminal of the storage module, and a second electrode of the storage capacitor is the second terminal of the storage module; and the drive transistor is a dual-gate transistor, wherein a first electrode of the dual-gate transistor is the first terminal of the drive module, and a second electrode of the dual-gate transistor is the second terminal of the drive module; and a bottom gate of the dual-gate transistor is the first control terminal of the drive module and a top gate of the dual-gate transistor is the second control terminal of the drive module, or a top gate of the dual-gate transistor is the first control terminal of the drive transistor, and a bottom gate of the dual-gate transistor is the second control terminal of the drive module.

13. The display panel of claim 9, further comprising: a reset module, wherein a control terminal of the reset module is electrically connected to a scanning signal input terminal of the pixel circuit, a first terminal of the reset module is electrically connected to a reference signal input terminal, and a second terminal of the reset module is electrically connected to an anode of the light emitting device, and the reset module is configured to reset the light emitting device.

14. The display panel of claim 13, wherein the reset module comprises a second transistor, wherein a gate of the second transistor is the control terminal of the reset module, a first electrode of the second transistor is the first terminal of the reset module, and a second electrode of the second transistor is the second terminal of the reset module.

15. The display panel of claim 9, further comprising: a sensor module, wherein a control terminal of the sensor module is electrically connected to a sensing control signal input terminal of the pixel circuit, a first terminal of the sensor module is electrically connected to an anode of the light emitting device, a second terminal of the sensor module is electrically connected to a sensing signal output terminal, and the sensor module is configured to sense a potential of the light emitting device.

16. The display panel of claim 15, wherein the sensor module comprises a third transistor, wherein a gate of the third transistor is the control terminal of the sensor module, a first electrode of the third transistor is the first terminal of the sensor module, and a second electrode of the third transistor is the second terminal of the sensor module.

* * * * *